US008478595B2

(12) United States Patent
Mizutani

(10) Patent No.: US 8,478,595 B2
(45) Date of Patent: Jul. 2, 2013

(54) FUNDAMENTAL FREQUENCY PATTERN GENERATION APPARATUS AND FUNDAMENTAL FREQUENCY PATTERN GENERATION METHOD

(75) Inventor: Nobuaki Mizutani, Yokohama (JP)

(73) Assignee: Kabushiki Kaisha Toshiba, Minato-Ku, Tokyo (JP)

( * ) Notice: Subject to any disclaimer, the term of this patent is extended or adjusted under 35 U.S.C. 154(b) by 757 days.

(21) Appl. No.: 12/205,626

(22) Filed: Sep. 5, 2008

(65) Prior Publication Data

US 2009/0070116 A1 Mar. 12, 2009

(30) Foreign Application Priority Data

Sep. 10, 2007 (JP) ..... 2007-234246

(51) Int. Cl.
*G10L 13/00* (2006.01)

(52) U.S. Cl.
USPC ..... 704/260; 704/266; 704/243; 704/9; 704/215; 704/251; 700/83

(58) Field of Classification Search
USPC ..... 704/258–278
See application file for complete search history.

(56) References Cited

U.S. PATENT DOCUMENTS 4,473,904 A * 9/1984 Suehiro et al. ..... 704/221
5,268,991 A * 12/1993 Tasaki ..... 704/220
5,625,749 A * 4/1997 Goldenthal et al. ..... 704/254
5,682,502 A * 10/1997 Ohtsuka et al. ..... 704/267
5,729,657 A * 3/1998 Svensson ..... 704/267
5,758,320 A * 5/1998 Asano ..... 704/258
5,899,966 A * 5/1999 Matsumoto et al. ..... 704/205
6,029,131 A * 2/2000 Bruckert ..... 704/260
6,101,470 A * 8/2000 Eide et al. ..... 704/260
6,424,937 B1 * 7/2002 Kato et al. ..... 704/207

(Continued)

FOREIGN PATENT DOCUMENTS

JP 2004-206144 7/2004

OTHER PUBLICATIONS

Eide, E., Aaron, A., Bakis, R., Cohen, P., Donovan, R., Hamza, W., Mathes, T., Picheny, M., Polkosky, M., Smith, M., U Viswanathan, M. 2003. Recent improvements to the IBM trainable speech synthesis system. In: Proc. ICASSP, Hong Kong, China, pp. 708-711.*

(Continued)

*Primary Examiner* — Pierre-Louis Desir
*Assistant Examiner* — Fariba Sirjani
(74) *Attorney, Agent, or Firm* — Ohlandt, Greeley, Ruggiero & Perle, L.L.P.

(57) ABSTRACT

A fundamental frequency pattern generation apparatus includes a first storage including representative vectors each corresponding to a prosodic control unit and having a section for changing the number of phonemes, a second storage unit including a rule to select a vector corresponding to an input context, a selection unit configured to select a vector from the representative vectors by applying the rule to the context and output the selected vector, a calculation unit configured to calculate an expansion/contraction ratio of the section of the selected vector in a time-axis direction based on a designated value for a specific feature amount related to a length of a fundamental frequency pattern to be generated, the designated value of the feature amount being required of the fundamental frequency pattern to be generated, and an expansion/contraction unit configured to expand/contract the selected vector based on the expansion/contraction ratio to generate the fundamental frequency pattern.

30 Claims, 15 Drawing Sheets

U.S. PATENT DOCUMENTS

| | | | | |
|---|---|---|---|---|
| 6,516,298 | B1 * | 2/2003 | Kamai et al. | 704/260 |
| 6,529,874 | B2 * | 3/2003 | Kagoshima et al. | 704/269 |
| 6,553,344 | B2 * | 4/2003 | Bellegarda et al. | 704/267 |
| 6,625,575 | B2 * | 9/2003 | Chihara | 704/260 |
| 6,823,309 | B1 * | 11/2004 | Kato et al. | 704/267 |
| 6,829,581 | B2 * | 12/2004 | Meron | 704/258 |
| 6,856,958 | B2 * | 2/2005 | Kochanski et al. | 704/260 |
| 6,941,267 | B2 * | 9/2005 | Matsumoto | 704/258 |
| 6,975,987 | B1 * | 12/2005 | Tenpaku et al. | 704/258 |
| 7,065,489 | B2 * | 6/2006 | Hisaminato et al. | 704/268 |
| 7,155,390 | B2 * | 12/2006 | Fukada | 704/254 |
| 7,200,558 | B2 * | 4/2007 | Kato et al. | 704/244 |
| 7,249,021 | B2 * | 7/2007 | Morio et al. | 704/258 |
| 7,349,847 | B2 * | 3/2008 | Hirose et al. | 704/260 |
| RE40,458 | E * | 8/2008 | Fredenburg | 704/1 |
| 7,447,635 | B1 * | 11/2008 | Konopka et al. | 704/275 |
| 7,464,034 | B2 * | 12/2008 | Kawashima et al. | 704/266 |
| 7,502,739 | B2 * | 3/2009 | Saito et al. | 704/260 |
| 7,761,296 | B1 * | 7/2010 | Bakis et al. | 704/247 |
| 7,809,572 | B2 * | 10/2010 | Yamagami et al. | 704/260 |
| 8,121,841 | B2 * | 2/2012 | Badino et al. | 704/260 |
| 8,160,882 | B2 * | 4/2012 | Mizutani | 704/266 |
| 8,195,464 | B2 * | 6/2012 | Morita et al. | 704/265 |
| 2001/0021906 | A1 * | 9/2001 | Chihara | 704/258 |
| 2001/0051872 | A1 * | 12/2001 | Kagoshima et al. | 704/260 |
| 2002/0138270 | A1 * | 9/2002 | Bellegarda et al. | 704/266 |
| 2002/0184032 | A1 * | 12/2002 | Hisaminato et al. | 704/268 |
| 2003/0018473 | A1 * | 1/2003 | Ohnishi et al. | 704/258 |
| 2003/0093273 | A1 * | 5/2003 | Koyanagi | 704/237 |
| 2003/0158721 | A1 * | 8/2003 | Kato et al. | 704/1 |
| 2004/0054537 | A1 * | 3/2004 | Morio et al. | 704/260 |
| 2005/0010414 | A1 * | 1/2005 | Yamazaki | 704/266 |
| 2006/0074678 | A1 * | 4/2006 | Pearson et al. | 704/267 |
| 2006/0224380 | A1 * | 10/2006 | Hirabayashi et al. | 704/207 |
| 2007/0067170 | A1 * | 3/2007 | Kress | 704/249 |
| 2007/0174056 | A1 * | 7/2007 | Sato | 704/260 |
| 2009/0055188 | A1 * | 2/2009 | Hirabayashi et al. | 704/260 |
| 2009/0177474 | A1 * | 7/2009 | Morita et al. | 704/260 |
| 2009/0254349 | A1 * | 10/2009 | Hirose et al. | 704/260 |
| 2009/0306987 | A1 * | 12/2009 | Nakano et al. | 704/260 |
| 2012/0143600 | A1 * | 6/2012 | Iriyama | 704/207 |

OTHER PUBLICATIONS

Mangayyagari, S.; Sankar, R.; , "Pitch conversion based on pitch mark mapping," SoutheastCon, 2007. Proceedings. IEEE , vol., No., pp. 8-13, Mar. 22-25, 2007.*

* cited by examiner

FUNDAMENTAL FREQUENCY PATTERN GENERATION APPARATUS AND FUNDAMENTAL FREQUENCY PATTERN GENERATION METHOD

CROSS-REFERENCE TO RELATED APPLICATIONS

This application is based upon and claims the benefit of priority from prior Japanese Patent Application No. 2007-234246, filed Sep. 10, 2007, the entire contents of which are incorporated herein by reference.

BACKGROUND OF THE INVENTION

1. Field of the Invention

The present invention relates to a fundamental frequency pattern generation apparatus and fundamental frequency pattern generation method which generate a fundamental frequency pattern for text-to-speech synthesis.

2. Description of the Related Art

A text-to-speech synthesis system has recently been developed, which artificially generates a speech signal from an arbitrary text. A text-to-speech synthesis system generally includes three modules (i.e., a language processing unit, a prosody generation unit, and a speech signal generation unit).

Of these modules, the performance of the prosody generation unit relates to the naturalness of synthesized speech. Especially, a fundamental frequency pattern that is the change pattern of voice tone (fundamental frequency) largely affects the naturalness of synthesized speech. In the fundamental frequency pattern generation method of conventional text-to-speech synthesis, the fundamental frequency pattern is generated using a relatively simple model. This method yields only mechanical synthesized speech with unnatural intonation.

A conventional fundamental frequency pattern generation apparatus solves this problem in the following way (e.g., JP-A 2004-206144(KOKAI)). First, a fundamental frequency pattern is selected from a fundamental frequency pattern database. Then, a section of the selected fundamental frequency pattern from "the second phoneme following the accent nucleus" to "the phoneme immediately before the accent phrase end" is interpolated within the range of four phonemes or less. This enables to generate a fundamental frequency pattern containing a desired number of phonemes.

However, if the interpolation range widens, the fundamental frequency pattern generation apparatus cannot generate natural synthesized speech.

To generate natural synthesized speech, it is necessary to set the interpolation range to four phonemes or less, as described above. To do this, the fundamental frequency database needs to store an enormous number of fundamental frequency patterns containing various numbers of phonemes. Hence, the size (capacity) of the fundamental frequency database increases.

As described above, it is difficult for the conventional technique to generate a fundamental frequency pattern which allows stable generation of natural synthesized speech closer to speech uttered by a human.

BRIEF SUMMARY OF THE INVENTION

According to an aspect of the present invention, there is provided a fundamental frequency pattern generation apparatus which includes a first storage unit to store a plurality of representative vectors each corresponding to a prosodic control unit and having a section for changing the number of phonemes, a second storage unit to store a rule to select a representative vector corresponding to an input context, a selection unit configured to select the representative vector corresponding to the input context from the plurality of representative vectors by applying the rule to the input context and output the selected representative vector, a calculation unit configured to calculate an expansion/contraction ratio of the section of the selected representative vector in a time-axis direction based on a designated value for a specific feature amount related to a length of a fundamental frequency pattern to be generated, the designated value of the feature amount being required of the fundamental frequency pattern to be generated, and an expansion/contraction unit configured to expand/contract the selected representative vector based on the expansion/contraction ratio to generate the fundamental frequency pattern.

DETAILED DESCRIPTION OF THE INVENTION

The embodiments of the present invention will now be described with reference to the accompanying drawing.

First Embodiment

Figure 1:
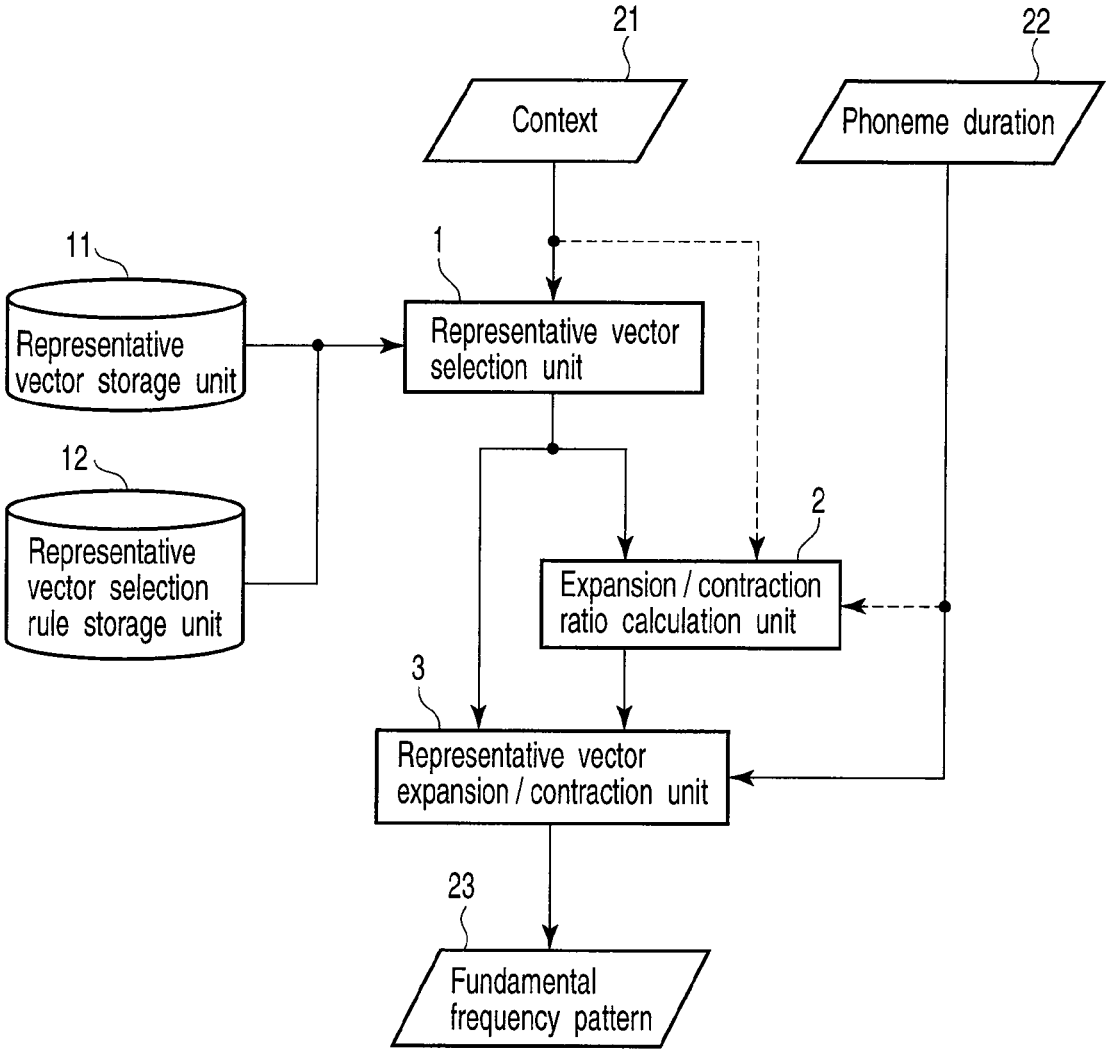
FIG. 1 is a block diagram showing an exemplary arrangement of a fundamental frequency pattern generation apparatus according to the first embodiment.

As shown in FIG. 1, the fundamental frequency pattern generation apparatus of this embodiment includes a representative vector selection unit 1, expansion/contraction ratio calculation unit 2, representative vector expansion/contraction unit 3, representative vector storage unit 11, and representative vector selection rule storage unit 12.

The representative vector storage unit 11 stores a plurality of representative vectors each corresponding to a prosodic control unit (e.g., accent phrase). A representative vector has a "variable phoneme count corresponding section" which makes the number of phonemes variable so as to allow generation of a fundamental frequency pattern containing various numbers of phonemes.

The representative vector selection rule storage unit 12 stores representative vector selection rules. The representative vector selection rules are used to select a representative vector corresponding to an input context 21.

The representative vector selection unit 1 applies the representative vector selection rules to the input context 21, thereby selecting a representative vector corresponding to the input context 21 from the plurality of representative vectors stored in the representative vector storage unit 11.

The expansion/contraction ratio calculation unit 2 calculates an expansion/contraction ratio in the time-axis direction for the variable phoneme count corresponding section in the selected representative vector using at least one of the input context 21 and an input phoneme duration 22.

The representative vector expansion/contraction unit 3 expands/contracts the selected representative vector using the calculated expansion/contraction ratio, thereby generating a fundamental frequency pattern 23 containing a desired number of phonemes.

Figure 2:
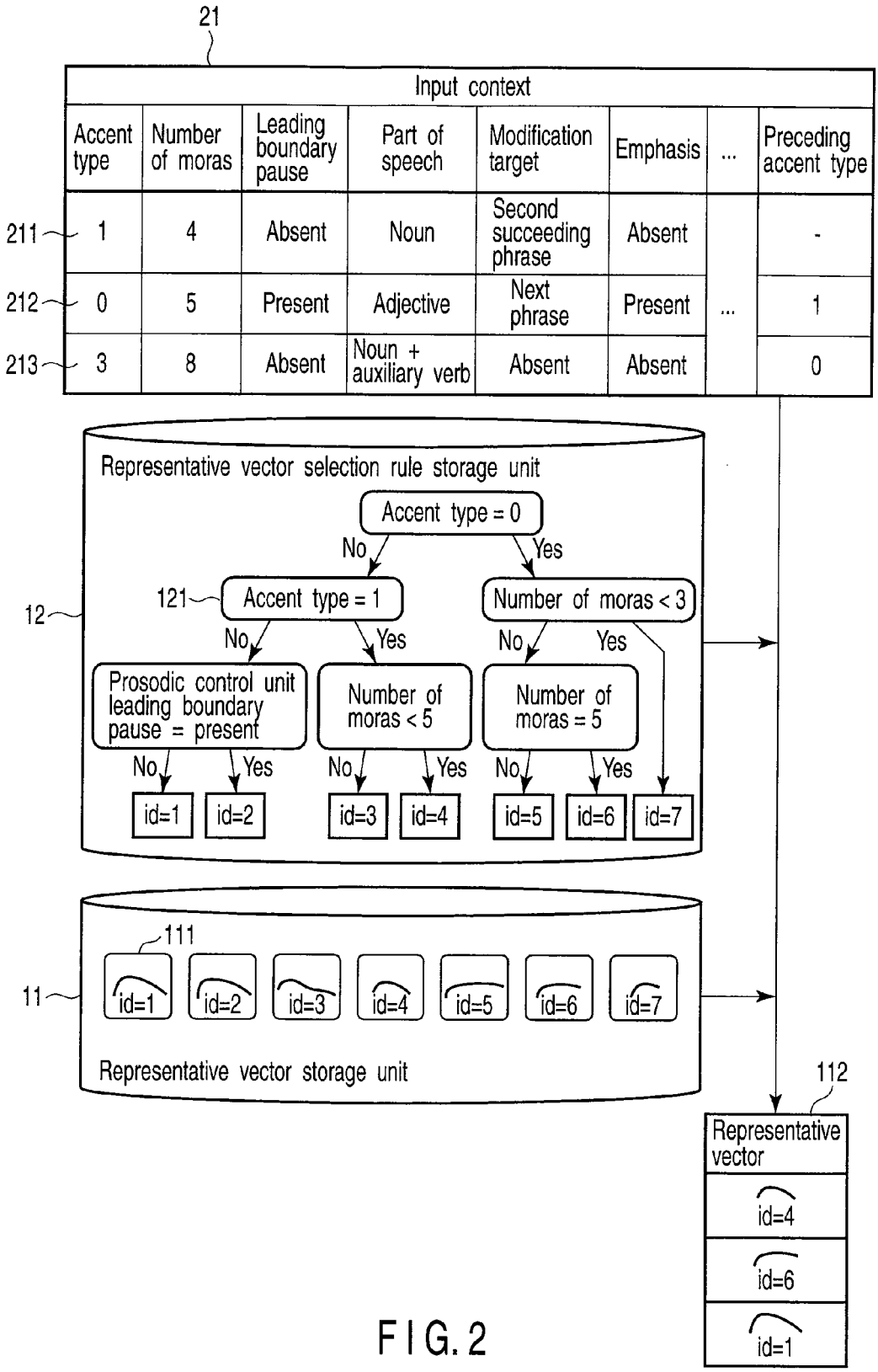
FIG. 2 is a view for explaining an exemplary operation of a representative vector selection unit according to the embodiment.

FIG. 2 shows an exemplary process of selecting a representative vector by applying a representative vector selection rule to the input context.

In this embodiment, a case in which an accent phrase is employed as the prosodic control unit will be described, but the embodiment is not limited thereto. In this embodiment, a case in which a mora is employed as a phoneme will be described, but the embodiment is not limited thereto.

The input context 21 contains sub-contexts each corresponding to an accent phrase. FIG. 2 shows three sub-contexts. When an accent phrase is employed as the prosodic control unit, each context (sub-context) can include all or some of the accent type of the accent phrase, the number of moras in the accent phrase, the presence/absence of leading boundary pause of the accent phrase, the part of speech of the accent phrase, the modification target of the accent phrase, the presence/absence of emphasis of the accent phrase, and the accent type of a preceding accent phrase that precedes the accent phrase concerned. Each context (sub-context) can also include any other information except for those described above.

In FIG. 1, the input phoneme duration 22 is input separately from the input context 21. However, the input context 21 may include, as an item, the input phoneme duration 22 or information capable of specifying the input phoneme duration 22.

A representative vector selection rule 121 is a selection rule having, for example, a decision tree (a regression tree). In the decision tree, a "classification rule about a context" which is called a "query" is associated with each node (non-leaf node). In the decision tree, representative vector identification information (hereinafter, referred to as "id") is associated with each leaf node.

This embodiment will be explained assuming that representative vector identification information is associated with each leaf node. However, the present invention is not limited to this. For example, each leaf node may directly refer to a representative vector.

The classification rule about a context can use a rule to determine, for example, whether "accent type=0," "accent type<2," "number of moras=3," "leading boundary pause=present," "part of speech=noun," "modification target<2," "emphasis=present," or "preceding accent type=0," or a combination of rules to determine, for example, whether "preceding accent type=0 and accent type=1."

The representative vector selection rule repeatedly determines, from the root node to a leaf node of the decision tree, whether the sub-context agrees with each query and finally selects a representative vector 111 corresponding to a leaf node.

For example, as indicated by a representative vector selection result 112 in FIG. 2, a representative vector id=4 is selected by applying the representative vector selection rule to a first sub-context 211. A representative vector id=6 is selected by applying the representative vector selection rule to a second sub-context 212. A representative vector id=1 is selected by applying the representative vector selection rule to a third sub-context 213.

Figure 3:
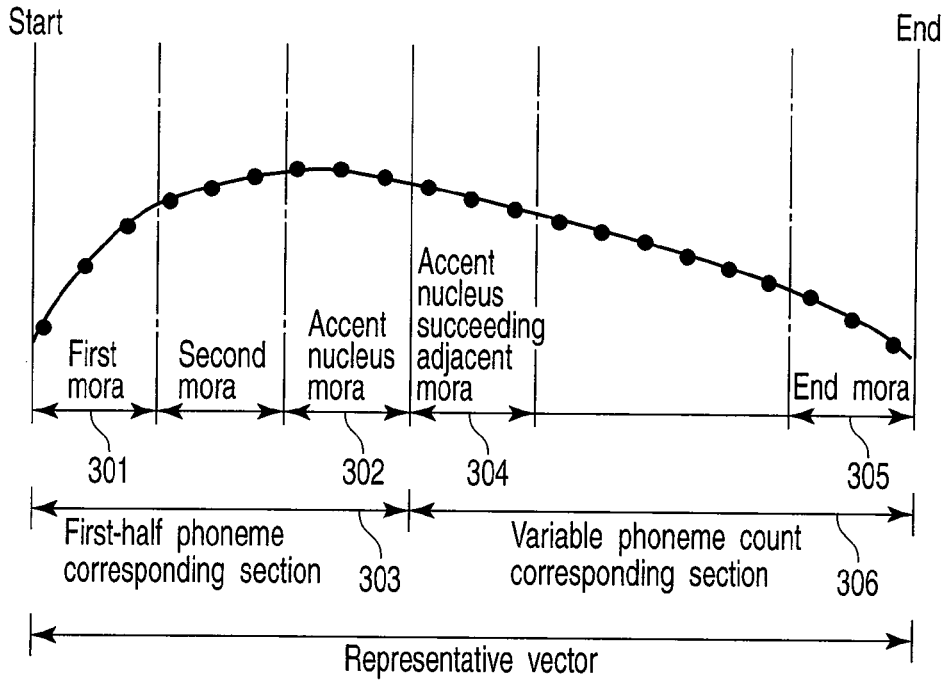
FIG. 3 is a graph for explaining an exemplary representative vector according to the embodiment.

FIG. 3 shows an exemplary representative vector. Note that the representative vector is a detailed exemplary representative vector id=1 in FIG. 2.

As shown in FIG. 3, the representative vector has a "first-half phoneme corresponding section" (303 in FIG. 3) from an "accent phrase start phoneme" (301 in FIG. 3) to an "accent nucleus phoneme" (302 in FIG. 3), and a "variable phoneme count corresponding section" (306 in FIG. 3) from an "accent nucleus succeeding adjacent phoneme" (304 in FIG. 3) to an "accent phrase end phoneme" (305 in FIG. 3). The "accent phrase start phoneme" 301 represents the phoneme of the start of the accent phrase. The "accent nucleus phoneme" 302 represents the phoneme of the accent nucleus. The "accent nucleus succeeding adjacent phoneme" 304 represents the phoneme next to the accent nucleus. The "accent phrase end phoneme" 305 represents the phoneme of the end of the accent phrase.

As shown in FIG. 3, the first-half phoneme corresponding section is sampled (normalized) at three points in each mora. The variable phoneme count corresponding section is sampled (normalized) at 12 points. In FIG. 3, the number of dimensions of the representative vector is 21.

When a mora is employed as a phoneme, the "accent phrase start phoneme" can be referred to as a "first mora" (or "accent phrase start mora"), the "accent nucleus phoneme" as an "accent nucleus mora," the "accent nucleus succeeding adjacent phoneme" as an "accent nucleus succeeding adjacent mora," and the "accent phrase end phoneme" as an "accent phrase end mora," as shown in FIG. 3. When one or more moras exist between the "first mora" and the "accent nucleus mora," as shown in FIG. 3, these moras can sequentially be referred to as a "second mora," "third mora," . . . .

The above-described representative vector is merely an example. The "variable phoneme count corresponding section" may start with the "accent nucleus phoneme," the "accent nucleus succeeding adjacent phoneme," or an "accent nucleus succeeding second phoneme" that is the second phoneme following the accent nucleus (the phoneme after the next to the accent nucleus). The "variable phoneme count corresponding section" may end with a "prosodic control unit end phoneme" that is the phoneme of the end of the prosodic control unit, a "prosodic control unit end preceding adjacent phoneme" that is the immediately preceding phoneme of the "prosodic control unit end phoneme," or a "prosodic control unit end preceding second phoneme" that is the second preceding phoneme of the "prosodic control unit end phoneme."

The representative vector includes the "first-half phoneme corresponding section" and "variable phoneme count corresponding section." Instead, the representative vector may include the "first-half phoneme corresponding section," "variable phoneme count corresponding section," and "second-half phoneme corresponding section." In this case, the first-half phoneme corresponding section may be, for example, a section from the "prosodic control unit start phoneme" to the "accent nucleus phoneme," from the "prosodic control unit start phoneme" to the "accent nucleus preceding adjacent phoneme" that is the immediately preceding phoneme of the "accent nucleus phoneme," or from the "prosodic control unit start phoneme" to the "accent nucleus succeeding adjacent phoneme" that is the immediately succeeding phoneme of the "accent nucleus phoneme." The second-half phoneme corresponding section may be, for example, a section from a "variable phoneme count corresponding section succeeding adjacent phoneme" that is the immediately succeeding phoneme of the variable phoneme count corresponding section to the "prosodic control unit end phoneme." The variable phoneme count corresponding section may be, for example, the section between the first-half phoneme corresponding section and the second-half phoneme corresponding section. Note that the boundary between the variable phoneme count corresponding section and the second-half phoneme corresponding section can appropriately be set.

The processing of the fundamental frequency pattern generation apparatus according to this embodiment will be described next.

Figure 4:
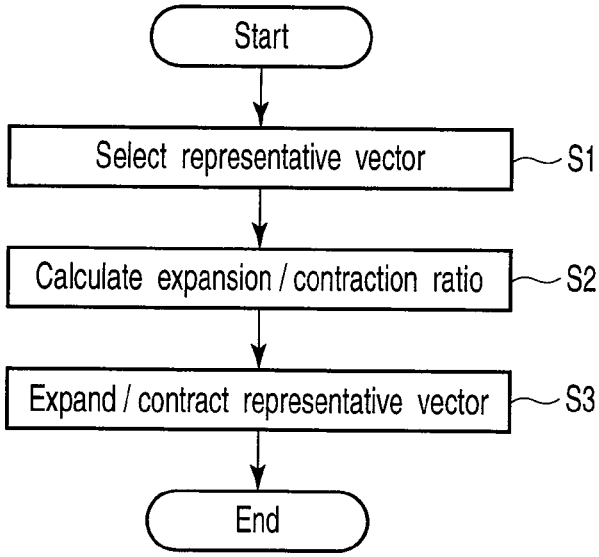
FIG. 4 is a flowchart illustrating an exemplary operation of the embodiment.

FIG. 4 illustrates an exemplary process procedure of the fundamental frequency pattern generation apparatus.

First, the representative vector selection unit 1 inputs the context 21. The representative vector selection unit 1 selects a representative vector corresponding to the context 21 from the plurality of representative vectors stored in the representative vector storage unit 11 using the representative vector selection rules stored in the representative vector selection rule storage unit 12 (step S1).

As described above, the representative vector selection rule shown in FIG. 2 is applied to each of the three input sub-contexts 211, 212, and 213 in FIG. 2 so that the representative vectors id=4, 6, and 1 are selected in correspondence with the input sub-contexts 211, 212, and 213, as indicated by the representative vector selection result 112 in FIG. 2.

For, for example, the sub-context 211 in the input context 21, "accent type=1, number of moras=4, leading boundary pause=absent, part of speech=noun, modification target=second succeeding phrase, emphasis=absent, . . . , preceding accent type=–." The sub-context disagrees (NO) with the query "accent type=0" of the root node of the decision tree, agrees (YES) with the query "accent type=1" of left child node, and also agrees (YES) with the query "number of moras<5" of right child node. As a result, the representative vector id=4 is selected for the sub-context 211.

Next, the expansion/contraction ratio calculation unit 2 calculates the expansion/contraction ratio of the "variable phoneme count corresponding section" using the input phoneme duration 22 (step S2).

Figure 5:
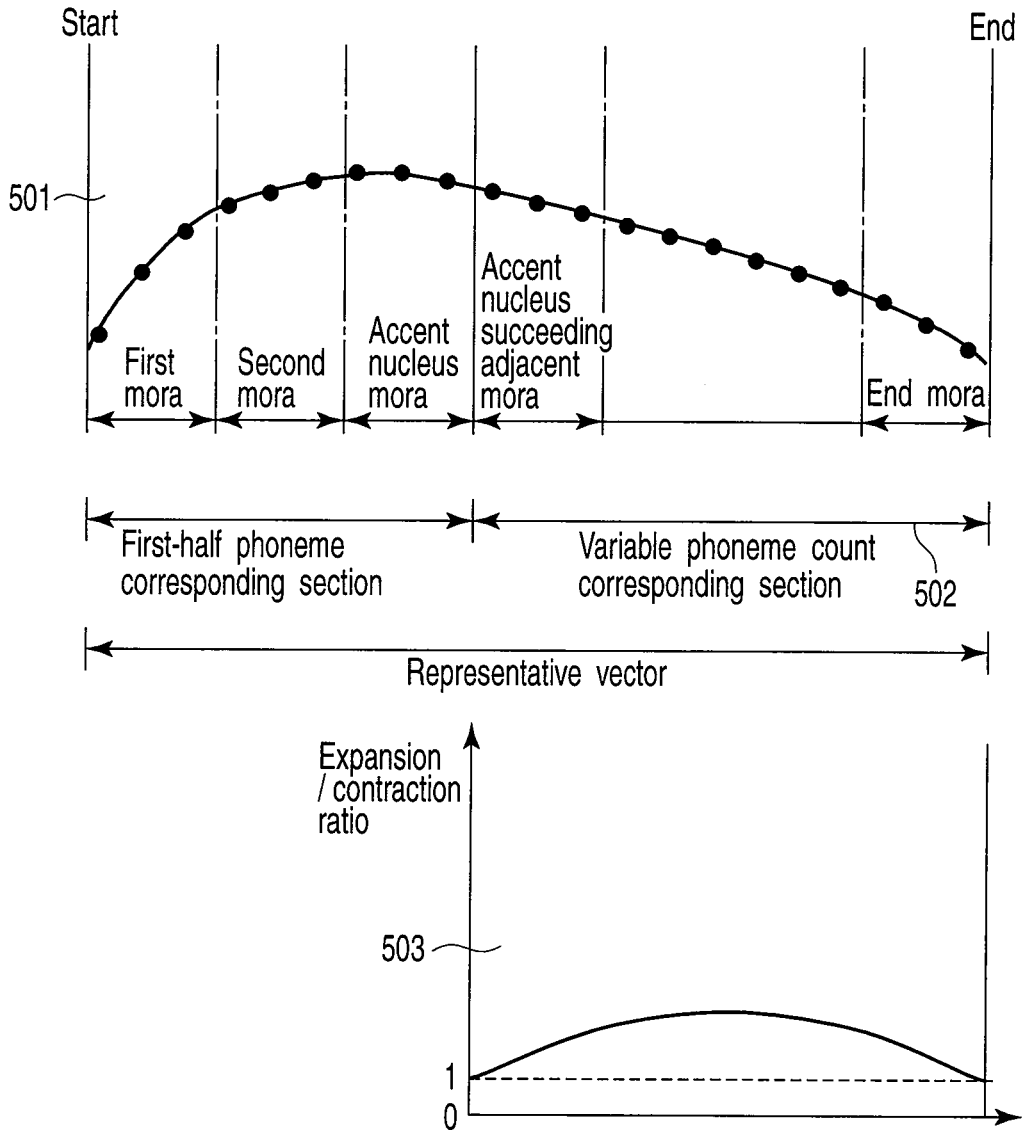
FIG. 5 is a view for explaining an exemplary operation of an expansion/contraction ratio calculation unit according to the embodiment.

FIG. 5 shows an exemplary expansion/contraction ratio of the variable phoneme count corresponding section. Referring to FIG. 5, reference numeral 501 denotes a representative vector that is the same as in FIG. 3; 502, a variable phoneme count corresponding section of the representative vector; and 503, an expansion/contraction ratio calculated for the variable phoneme count corresponding section using the input phoneme duration 22.

The expansion/contraction ratio of the variable phoneme count corresponding section can be calculated in, for example, the following way.

Let Y be the number of dimensions (length) of the variable phoneme count corresponding section of the representative vector, and X be the number of dimensions (length) from the "accent nucleus succeeding adjacent mora" to the "accent phrase end mora" in the fundamental frequency pattern to be generated.

Figure 6:
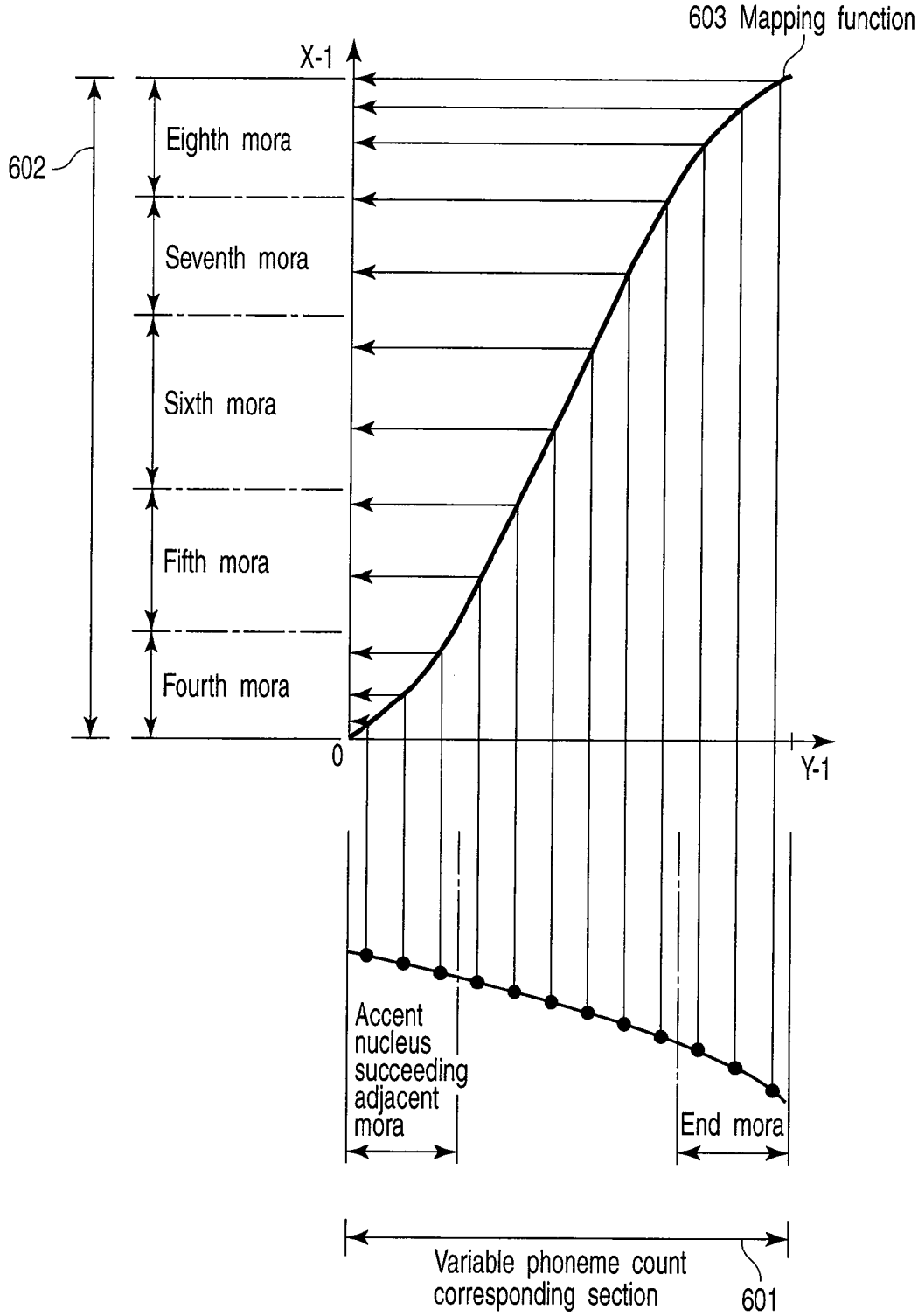
FIG. 6 is a graph for explaining an exemplary mapping function related to expansion/contraction ratio calculation according to the embodiment.

The relationship (mapping function) between a point y in the representative vector and a position x in the fundamental frequency pattern to be generated, which corresponds to the point y is expressed by equation (1) and FIG. 6. In FIG. 6, reference numeral 601 denotes a variable phoneme count corresponding section in the representative vector; 602, a section from the "accent nucleus succeeding adjacent mora" to the "accent phrase end mora" in the fundamental frequency pattern to be generated; and 603, a mapping function.

$$x=(X-1)\{\gamma-w(\gamma-f(\gamma))\},$$

$$y=(Y-1)\{f(\gamma)+w(\gamma-f(\gamma))\},$$

$$f(\gamma)=\{g(\alpha)-g(-\alpha)\}^{-1}\cdot g(2\alpha\gamma-\alpha),$$

$$g(u)=\{1+\exp(-u)\}^{-1}. \quad (1)$$

Where w and γ satisfy $0 \leqq w \leqq 1$ and $0 \leqq \gamma \leqq 1$. Parameter αsets the finite domain of a sigmoid function g. A function f normalizes the domain and range of the sigmoid function with the finite domain to [0,1].

Additionally, w may be set based on the ratio of the input phoneme duration to the length of the representative vector. For example, if the input phoneme duration equals the representative vector length, w is set to 0.5. If the input phoneme duration is larger than the representative vector length, w is set to a real number smaller than 0.5. If the input phoneme duration is smaller than the representative vector length, w is set to a real number larger than 0.5.

The functions f and g need not always be used.

When the value x calculated using a parameter γ that satisfies the point y=b is given by x{yb}, an expansion/contraction ratio z{yb} at the point y=b in the representative vector can be calculated by $$z\{yb\}=\lim_{h\to 0}[x\{yb+h\}-x\{yb\}]/h \quad (2)$$

The expansion/contraction ratio z{yb} is obtained in the range of b=0 to b=Y−1, thereby obtaining the expansion/contraction ratio of the variable phoneme count corresponding section in the representative vector.

Next, the representative vector expansion/contraction unit 3 expands/contracts the representative vector using the input phoneme duration 22 and the expansion/contraction ratio of the variable phoneme count corresponding section (step S3).

Figure 7:
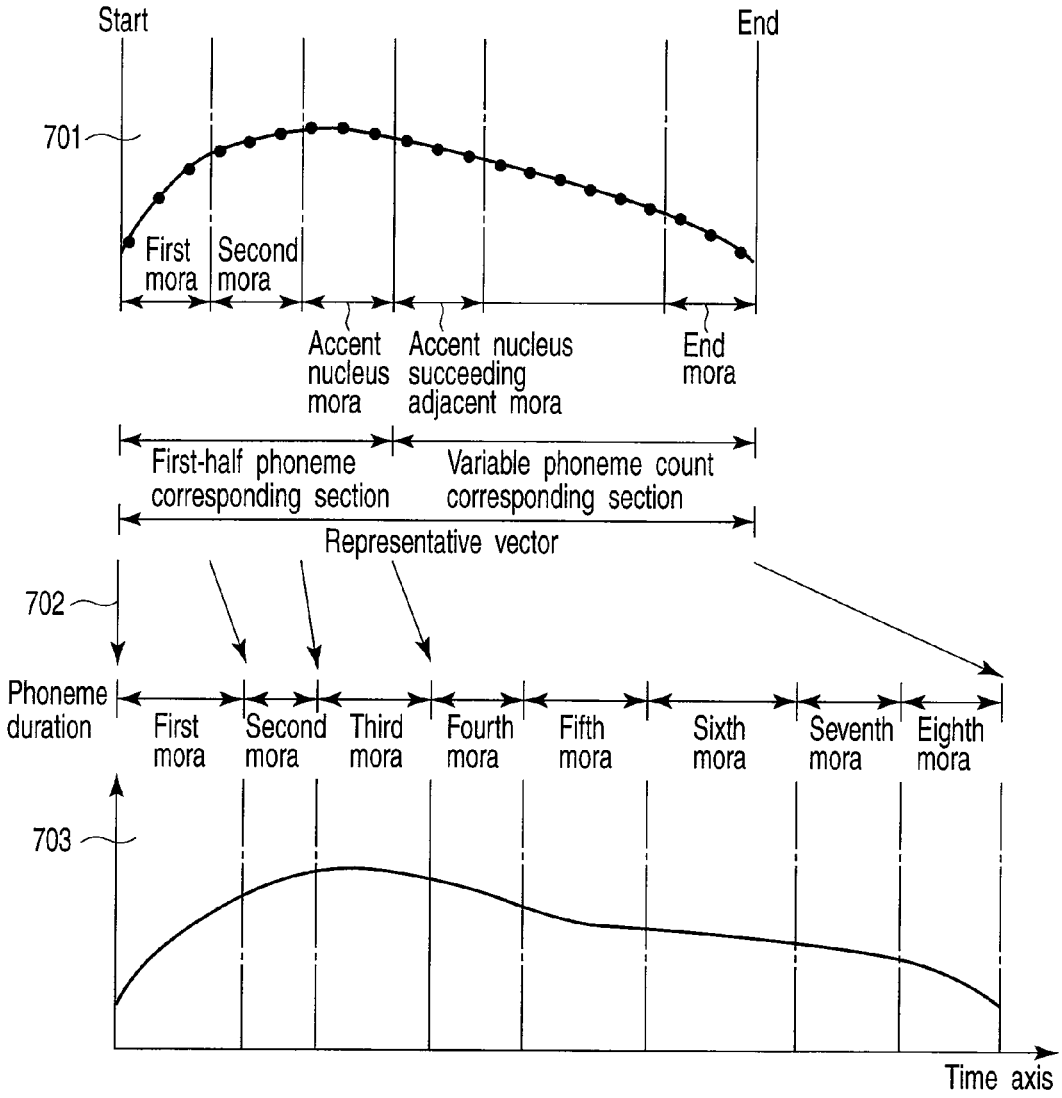
FIG. 7 is a graph for explaining an example of the operation of a representative vector expansion/contraction unit according to the embodiment.

FIG. 7 shows an exemplary expansion/contraction of the representative vector. Referring to FIG. 7, reference numeral 701 denotes a representative vector that is the same as in FIG. 3; 702, an example of expansion/contraction of the representative vector; and 703, an example of an expanded/contracted representative vector (generated fundamental frequency pattern).

As shown in FIG. 7, the "first-half phoneme corresponding section" (first mora, second mora, and third mora (accent nucleus phoneme)) in the representative vector is linearly expanded/contracted in each mora in accordance with the input phoneme duration 22. On the other hand, the "variable phoneme count corresponding section" (fourth to seventh moras) in the representative vector is expanded/contracted in accordance with the expansion/contraction ratio obtained in step S2.

The expansion/contraction of the first-half phoneme corresponding section in the representative vector is not limited to the above-described linear expansion/contraction of each mora. For example, expansion/contraction combined with a linear function, expansion/contraction combined with a sigmoid function too, or expansion/contraction also combined with a multidimensional Gaussian function or the like may be used to express more natural intonation.

The fundamental frequency pattern generation apparatus of this embodiment outputs the representative vector expanded/contracted by the representative vector expansion/contraction unit 3 as the fundamental frequency pattern 23 containing a desired number of phonemes.

As described above, in this embodiment, to generate a fundamental frequency pattern containing various numbers of phonemes, a representative vector serving as a prosodic control unit has a variable phoneme count corresponding section. A representative vector corresponding to an input context is selected by applying the representative vector selection rules to it. The expansion/contraction ratio, in the time-axis direction, of the variable phoneme count corresponding section in the selected representative vector is calculated using at least one of the input context and the input phoneme duration. The selected representative vector is expanded/contracted using the calculated expansion/contraction ratio, thereby generating a fundamental frequency pattern. This allows stable generation of natural synthesized speech closer to speech uttered by a human.

Variations of the matters described above will be explained below.

The prosodic control unit is a unit to control the prosodic feature of speech corresponding to an input context and is supposed to have a relation to the capacity of a representative vector. In this embodiment, for example, "sentence," "breath group," "accent phrase," "morpheme," "word," "mora," "syllable," "phoneme," "semi-phoneme," or "unit obtained by dividing one phoneme into a plurality of parts by, for example, HMM," or a "combination thereof" is usable as the prosodic control unit.

The context can use, of information used by a rule synthesizer, pieces of information that are supposed to affect the intonation such as "accent type," "number of moras," "phoneme type," "presence/absence of an accent phrase boundary pause," "accent phrase position in the text," "part of speech," "language information about a preceding prosodic control unit, succeeding prosodic control unit, second preceding prosodic control unit, second succeeding prosodic control unit, or prosodic control unit of interest, which is, for example, a modification target obtained by analyzing the text," or "at least one value of predetermined attributes." Examples of the predetermined attributes are "information about prominence which is supposed to affect a change in, for example, the accent," "information such as intonation or utterance style which is supposed to affect a change in the fundamental frequency pattern of whole utterance," "information representing an intention such as question, conclusion, or emphasis," and "information representing a mental attitude such as doubt, interest, disappointment, or admiration."

As the phoneme, "mora," "syllable," "phoneme," "semi-phoneme," or "unit obtained by dividing one phoneme into a plurality of parts by, for example, HMM" can flexibly be used for the viewpoint of, for example, implementation of the apparatus.

As the representative vector, for example, a fundamental frequency pattern extracted from natural speech representing a time-rate change in the intonation or a vector obtained by executing statistical processing (e.g., vector quantization, approximation, averaging, or vector quantization and approximation) for a set of fundamental frequency patterns extracted from natural speech is usable. As the fundamental frequency pattern, a sequence of a fundamental frequency pattern itself, or a sequence of a logarithmic fundamental frequency that considers human auditory sense in perceiving a sound tone is usable. No fundamental frequency exists in a voiceless sound section. However, a continuous sequence obtained by, for example, interpolating time series points in preceding and succeeding boundary vocal sound sections or continuously embedding special values is usable. The number of dimensions of the sequence can be the obtained dimension count itself, or a number obtained by sampling (normalizing) several samples in each corresponding phoneme/variable phoneme count corresponding section that is supposed to affect the reduction of the capacity of the representative vector is usable.

As the representative vector selection rule, a selection rule which generates a model of the quantification method of the first type for measuring an estimated error using, as a dependent variable, the error between a fundamental frequency pattern generated by a representative vector and a target (ideal) fundamental frequency pattern and the context as an explanatory variable and selects a representative vector with the minimum estimated error using the model of the quantification method of the first type may be used.

As the model for measuring the estimated error, a cost function generally used in a unit (speech segment) selection type speech synthesis method may be used. Use of a cost function enables to introduce knowledge effective in unit selection type speech synthesis in advance in the cost function or sub-cost function and generate a representative vector selection rule in a short time.

A representative vector selection rule may select two or more representative vectors. For example, if the estimated error exceeds a predetermined threshold value, it may be impossible to obtain natural synthesized speech by only one representative vector. When two or more representative vectors are selected and combined, weighted and added, or averaged, more robust and natural synthesized speech is expected to be obtained.

Figure 8:
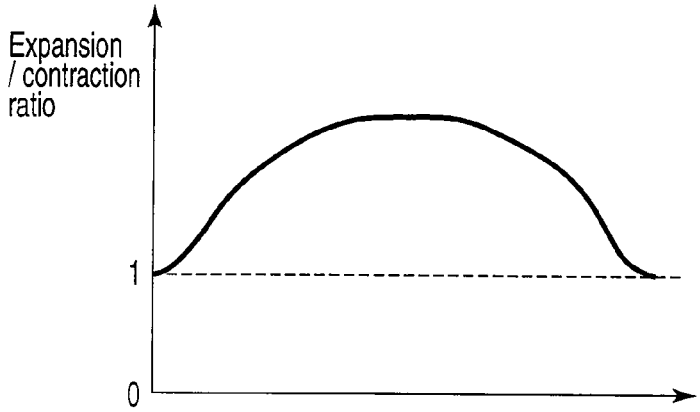
FIG. 8 is a graph for explaining the first example of an expansion/contraction ratio according to the embodiment.
Figure 9:
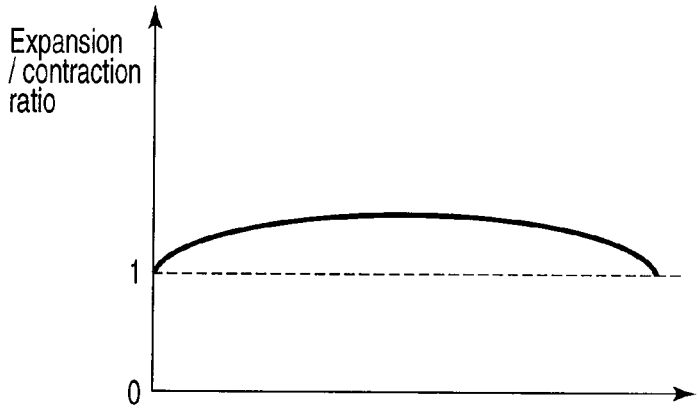
FIG. 9 is a graph for explaining the second example of the expansion/contraction ratio according to the embodiment.
Figure 10:
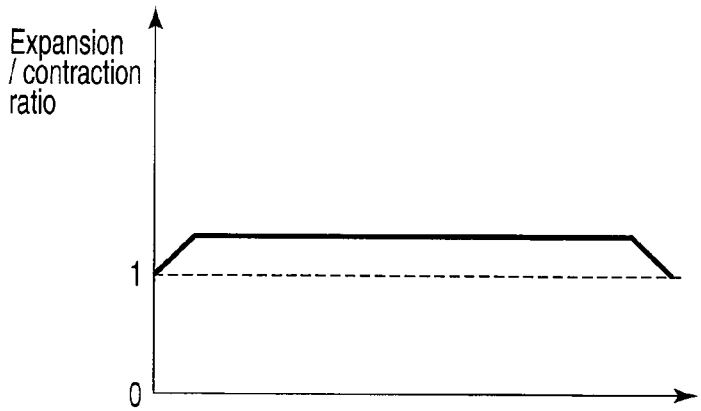
FIG. 10 is a graph for explaining the third example of the expansion/contraction ratio according to the embodiment.
Figure 11:
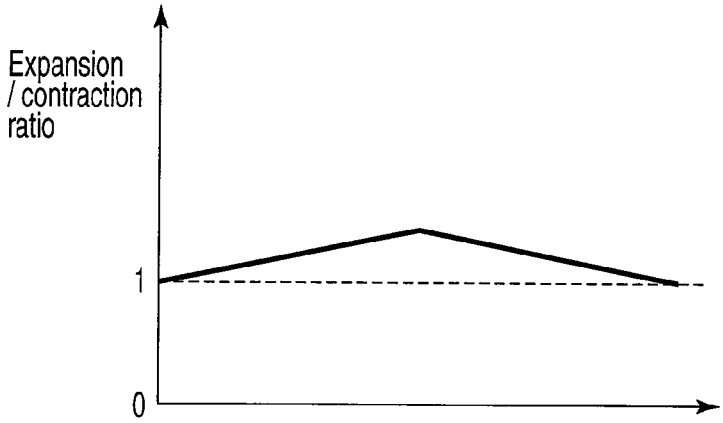
FIG. 11 is a graph for explaining the fourth example of the expansion/contraction ratio according to the embodiment.
Figure 12:
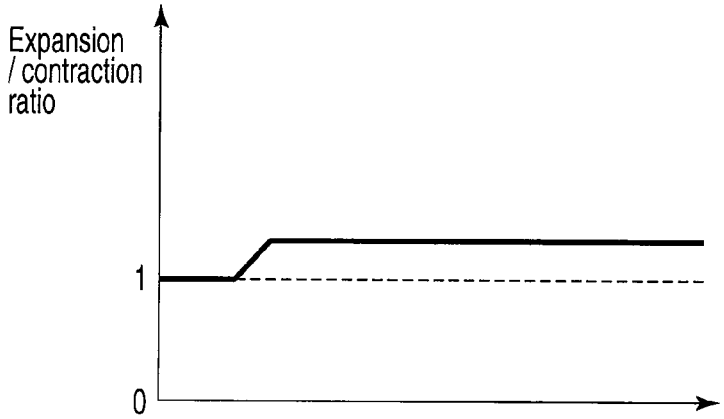
FIG. 12 is a graph for explaining the fifth example of the expansion/contraction ratio according to the embodiment.
Figure 13:
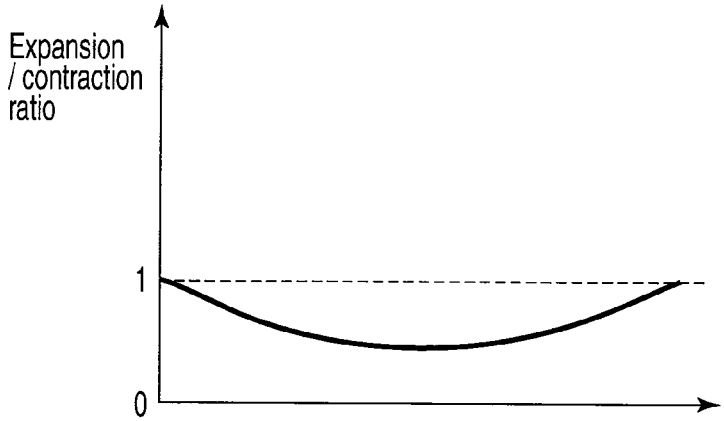
FIG. 13 is a graph for explaining the sixth example of the expansion/contraction ratio according to the embodiment.

The expansion/contraction ratio calculation unit 2 may calculate an expansion/contraction ratio which largely expands a portion near the center of the variable phoneme count corresponding section by setting w in equation (1) to a small value, as shown in FIG. 8. The expansion/contraction ratio calculation unit 2 may calculate an expansion/contraction ratio having a shape obtained by combining ellipses or parabolas, as shown in FIG. 9. The expansion/contraction ratio calculation unit 2 may calculate an expansion/contraction ratio for expanding the vector at a constant ratio except for the portions near the start and the end of the variable phoneme count corresponding section, as shown in FIG. 10. The expansion/contraction ratio calculation unit 2 may calculate an expansion/contraction ratio which rises toward the center of the variable phoneme count corresponding section and then lowers at a constant ratio, as shown in FIG. 11. The expansion/contraction ratio calculation unit 2 may calculate an expansion/contraction ratio for expanding the vector at a constant ratio except for the portion near the start of the variable phoneme count corresponding section, as shown in FIG. 12. The expansion/contraction ratio calculation unit 2 may calculate an expansion/contraction ratio for wholly contracting the variable phoneme count corresponding section, as shown in FIG. 13. Alternatively, the expansion/contraction ratio calculation unit 2 may calculate an expansion/contraction ratio having a shape of an well-known curve such as a probable curve, equitangential curve (tractrix), catenary, cycloid, trochoid, witch of Agnesi, and clothoid. Additionally, the expansion/contraction ratio calculation unit 2 may calculate an expansion/contraction ratio having a shape obtained by combining one or more of the curves with one or more of the above-described shapes in FIGS. 8 to 13.

In this embodiment, the expansion/contraction ratio of the variable phoneme count corresponding section is calculated. However, calculating an expansion/contraction amount is substantially equivalent.

Figure 14:
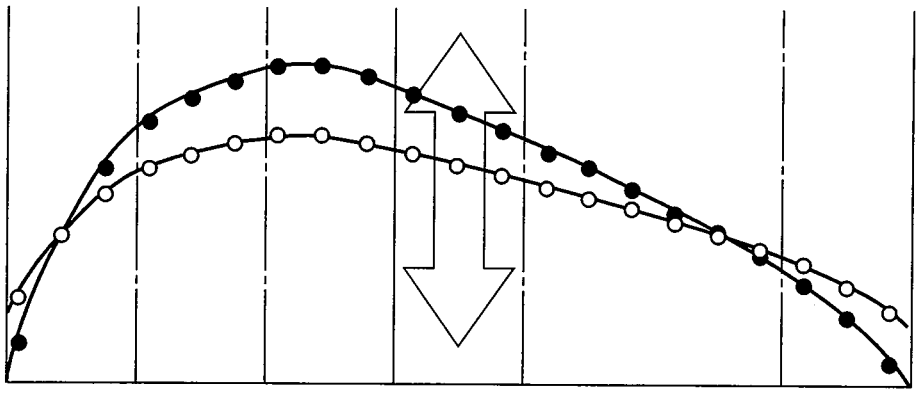
FIG. 14 is a graph for explaining an example of the operation of representative vector deformation processing according to the embodiment.
Figure 15:
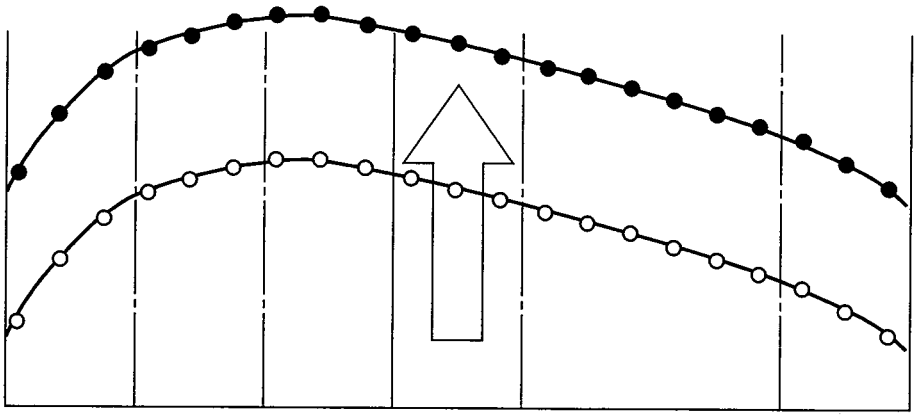
FIG. 15 is a graph for explaining another example of the operation of representative vector deformation processing according to the embodiment.

As shown in FIG. 4, the representative vector expansion/contraction step (step S3) is performed next to the expansion/contraction ratio calculation step (step S2). However, the representative vector expansion/contraction step may be next to a step that is generally performed. Exemplary step that is generally performed is expansion/contraction of a representative vector in the direction of the fundamental frequency axis, as shown in FIG. 14, and movement of a representative vector in the direction of the fundamental frequency axis, as shown in FIG. 15. As shown in FIG. 14 or 15, an output from a model obtained by a known method (e.g., a statistical method such as the quantification method of the first type, some inductive learning method, multidimensional normal distribution, or GMM) may be used as a parameter (or a combination of parameters) necessary for performing the step.

As described above, according to this embodiment, a representative vector having a "variable phoneme count corresponding section" which allows generation of a fundamental frequency pattern containing more various numbers of phonemes is expanded/contracted to generate a fundamental frequency pattern containing a desired number of phonemes. This enables to generate a fundamental frequency pattern which allows stable generation of natural synthesized speech closer to speech uttered by a human. It also enables to reduce the number of representative vectors to be stored.

This fundamental frequency pattern generation apparatus can also be implemented by using, for example, a general-purpose computer apparatus as basic hardware. More specifically, the representative vectors, representative vector selection rules, representative vector selection unit 1, expansion/contraction ratio calculation unit 2, and representative vector expansion/contraction unit 3 can be implemented by causing the processor of the computer apparatus to execute programs stored in a computer readable storage medium. At this time, the fundamental frequency pattern generation apparatus may be implemented by either installing the programs in the computer apparatus in advance or storing the programs in a storage medium such as a CD-ROM or distributing them via a network and appropriately installing them in the computer apparatus. The representative vectors and representative vector selection rules can be implemented by appropriately using an internal or external memory or hard disk of the computer apparatus or a storage medium such as a CD-R, CD-RW, DVD-RAM, or DVD-R.

Second Embodiment

The second embodiment will be described next mainly in association with the different points from the first embodiment.

There will now be described an exemplary arrangement of a fundamental frequency pattern generation apparatus referring to FIG. 16. The same reference numerals as in FIG. 1 denote equivalent portions in FIG. 16.

Figure 16:
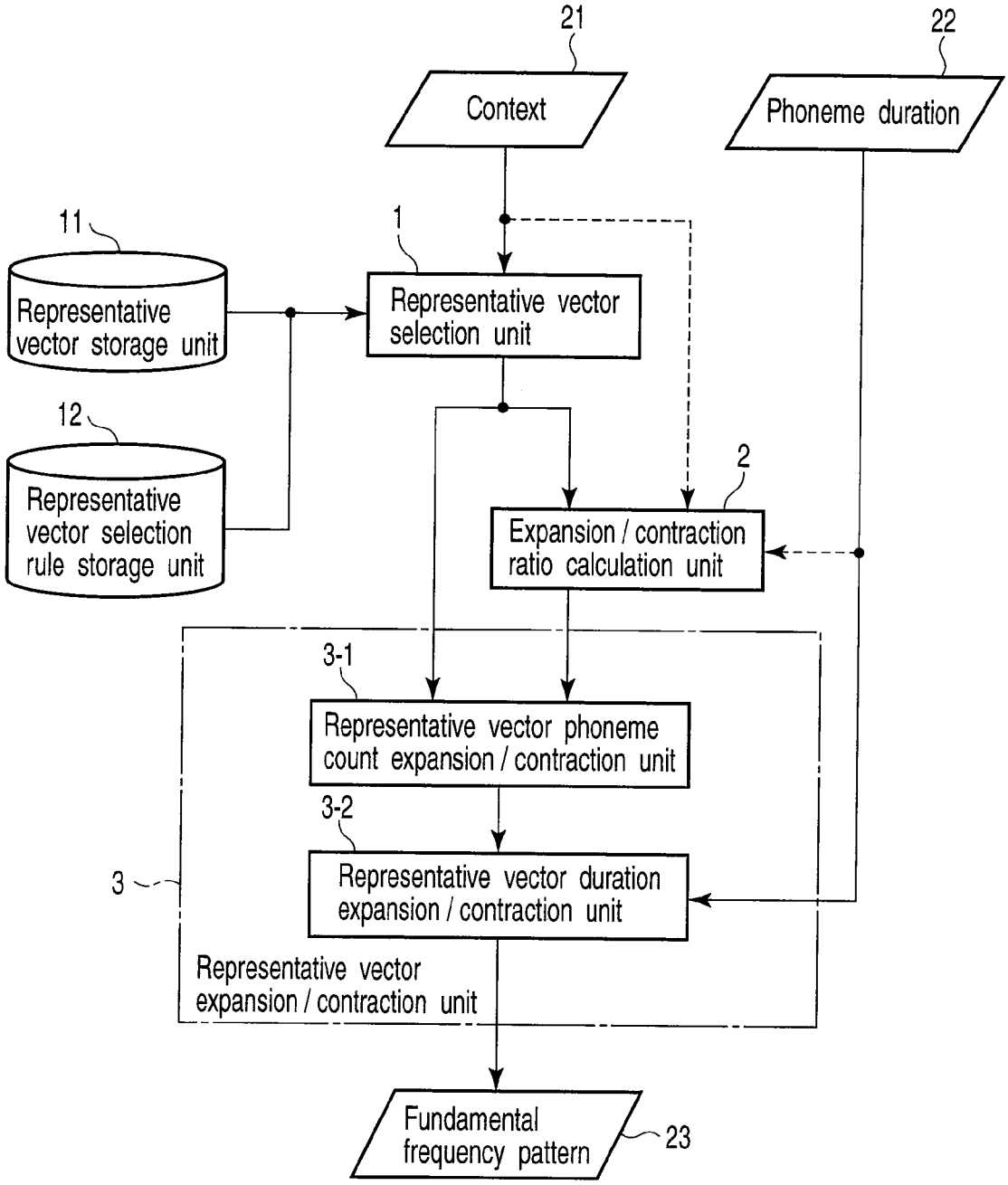
FIG. 16 is a block diagram showing an arrangement example of a fundamental frequency pattern generation apparatus according to the second embodiment.

In FIG. 16, an input phoneme duration 22 is input separately from an input context 21. However, the input context 21 may include, as an item, the input phoneme duration 22 or information capable of specifying the input phoneme duration 22.

The main difference between the fundamental frequency pattern generation apparatus of the second embodiment and that of the first embodiment is that a representative vector expansion/contraction unit 3 includes a representative vector phoneme count expansion/contraction unit 3-1 and a representative vector duration expansion/contraction unit 3-2.

The operation of the fundamental frequency pattern generation apparatus according to this embodiment will be described next.

Figure 17:
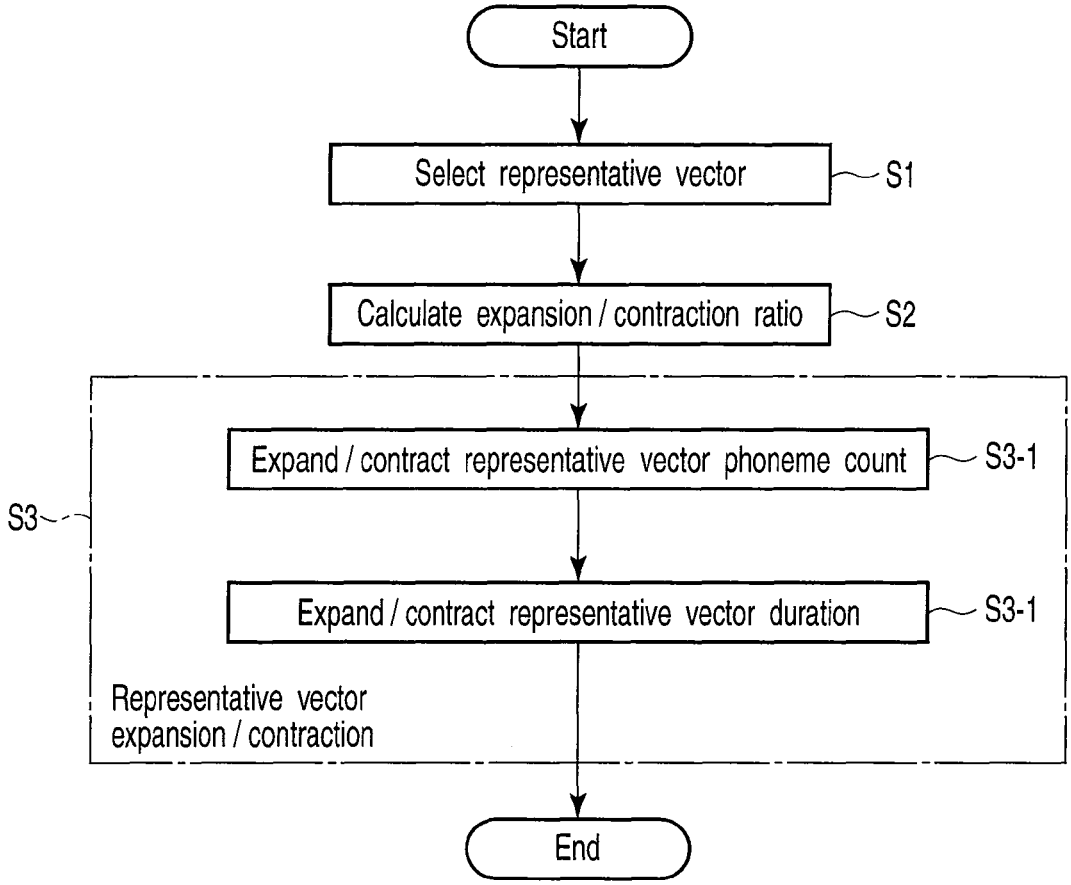
FIG. 17 is a flowchart illustrating an example of the operation of the embodiment.

FIG. 17 illustrates an exemplary process procedure of the fundamental frequency pattern generation apparatus. The same step numbers as in FIG. 4 denote equivalent steps in FIG. 17.

The second embodiment is different from the first embodiment in two points. The first difference is the process of an expansion/contraction ratio calculation unit 2. In the first embodiment, the expansion/contraction ratio calculation unit 2 calculates an expansion/contraction ratio based on the phoneme duration of a fundamental frequency pattern to be generated. In the second embodiment, however, the expansion/contraction ratio calculation unit 2 calculates an expansion/contraction ratio based on the "number of phonemes" of a fundamental frequency pattern to be generated. The second difference is the representative vector expansion/contraction unit 3. In the first embodiment, a fundamental frequency pattern is generated by expansion/contraction of one step. In the second embodiment, however, a fundamental frequency pattern is generated by expansion/contraction of two steps.

The first difference will be described.

In an expansion/contraction ratio calculation step S2 of this embodiment, the expansion/contraction ratio calculation unit 2 calculates an expansion/contraction ratio for expanding/contracting the "variable phoneme count corresponding section" so that the number of samples (number of dimensions) of a representative vector equals a desired number of phonemes.

An embodiment in which a mora is employed as a phoneme will be examined.

Figure 18:
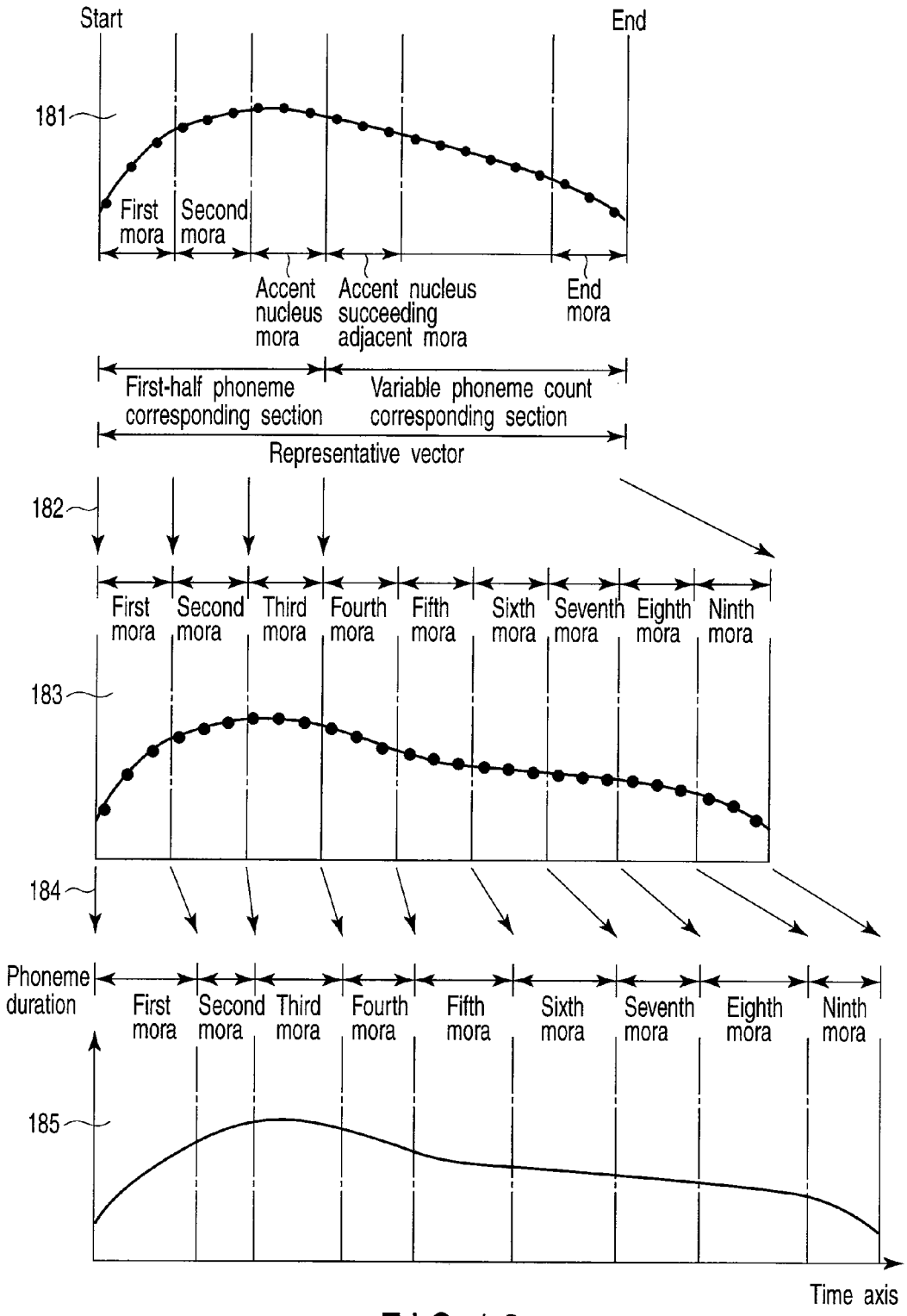
FIG. 18 is a graph for explaining an example of the operation of a representative vector expansion/contraction unit according to the embodiment.

FIG. 18 shows an exemplary representative vector expansion/contraction. Referring to FIG. 18, reference numeral 181 denotes a representative vector that is the same as in FIG. 3; 182, an exemplary expansion/contraction of the number of phonemes of the representative vector; 183, an exemplary representative vector whose phoneme count has been expanded/contracted; 184, an exemplary expansion/contraction of the duration of a representative vector; and 185, an exemplary representative vector whose duration has been expanded/contracted.

FIG. 18 shows, as an exemplary phoneme count expansion/contraction, phoneme count expansion/contraction of changing a representative vector having an accent type "3" and a variable phoneme count corresponding section sampled at 12 points to a representative vector containing nine moras.

The representative vector 181 is an embodiment having three samples per mora in the first-half phoneme corresponding section and twelve sample points in the variable phoneme count corresponding section such that the number of dimensions of the representative vector is 21. When an expansion/contraction ratio for expanding the variable phoneme count corresponding section from 12 samples to 18 samples (3×6 moral) is calculated, the representative vector 183 corresponding to a desired number of phonemes can be obtained.

To obtain the desired number of phonemes, for example, the desired number of phonemes corresponding to the variable phoneme count corresponding section is given as an item of the input context. Alternatively, a method of giving the accent type and the number of moras as items of the input context and subtracting the accent type from the number of moras, or a method of adding the variable phoneme count corresponding section to the input phoneme duration and using the number of phonemes of the variable phoneme count corresponding section is available.

The second difference will be described.

The representative vector expansion/contraction step of this embodiment includes a representative vector phoneme count expansion/contraction step S3-1 and a representative vector duration expansion/contraction step S3-2.

FIG. 18 shows an exemplary operation of the representative vector expansion/contraction step. In the representative vector phoneme count expansion/contraction S3-1 (see 182 in FIG. 18), the variable phoneme count corresponding section in the representative vector is expanded/contracted using the obtained expansion/contraction ratio. In the representative vector duration expansion/contraction step S3-2 (see 184 in FIG. 18), each mora in the representative vector, which corresponds to the number of generated phonemes, is linearly expanded/contracted using the input phoneme duration 22. As a result, the representative vector 185 can be obtained.

Expansion/contraction in the representative vector duration expansion/contraction step S3-2 need not be limited to linear expansion/contraction of each mora. For example, expansion/contraction combined with a linear function, expansion/contraction combined with a sigmoid function too, or expansion/contraction also combined with a multidimensional Gaussian function or the like may be used to express more natural intonation.

In this embodiment, representative vector expansion/contraction is done in two steps. Since the representative vector has the number of samples (number of dimensions) corresponding to the number of phonemes to be generated, it is necessary to only perform, for each phoneme, expansion/contraction according to the duration in the representative vector duration expansion/contraction step. That is, it is unnecessary to be conscious of each corresponding section in the representative vector, and the process is easy.

As described above, in this embodiment, to generate a fundamental frequency pattern containing various numbers of phonemes, a representative vector serving as a prosodic control unit has a variable phoneme count corresponding section. A representative vector corresponding to an input context is selected by applying the representative vector selection rules to it. The expansion/contraction ratio, in the time-axis direction, of the variable phoneme count corresponding section in the selected representative vector is calculated using at least one of the input context and the input phoneme duration. The selected representative vector is expanded/contracted to a desired number of phonemes using the calculated expansion/contraction ratio, and the representative vector containing the desired number of phonemes is further expanded/contracted using the input phoneme duration, thereby generating a fundamental frequency pattern. This allows stable generation of natural synthesized speech closer to speech uttered by a human.

This fundamental frequency pattern generation apparatus can also be implemented by using, for example, a general-purpose computer apparatus as basic hardware. More specifically, the representative vectors, representative vector selection rules, representative vector selection unit 1, expansion/contraction ratio calculation unit 2, representative vector phoneme count expansion/contraction unit 3-1, and representative vector duration expansion/contraction unit 3-2 can be implemented by causing the processor of the computer apparatus to execute programs. At this time, the fundamental frequency pattern generation apparatus may be implemented by either installing the programs in the computer apparatus in advance or storing the programs in a storage medium such as a CD-ROM or distributing them via a network and appropriately installing them in the computer apparatus. The representative vectors and representative vector selection rules can be implemented by appropriately using an internal or external memory or hard disk of the computer apparatus or a storage medium such as a CD-R, CD-RW, DVD-RAM, or DVD-R.

Third Embodiment

The third embodiment will be described next mainly in association with the different points from the first embodiment.

There will now be described an exemplary arrangement of a fundamental frequency pattern generation apparatus referring to FIG. 19. The same reference numerals as in FIG. 1 denote equivalent portions in FIG. 19.

Figure 19:
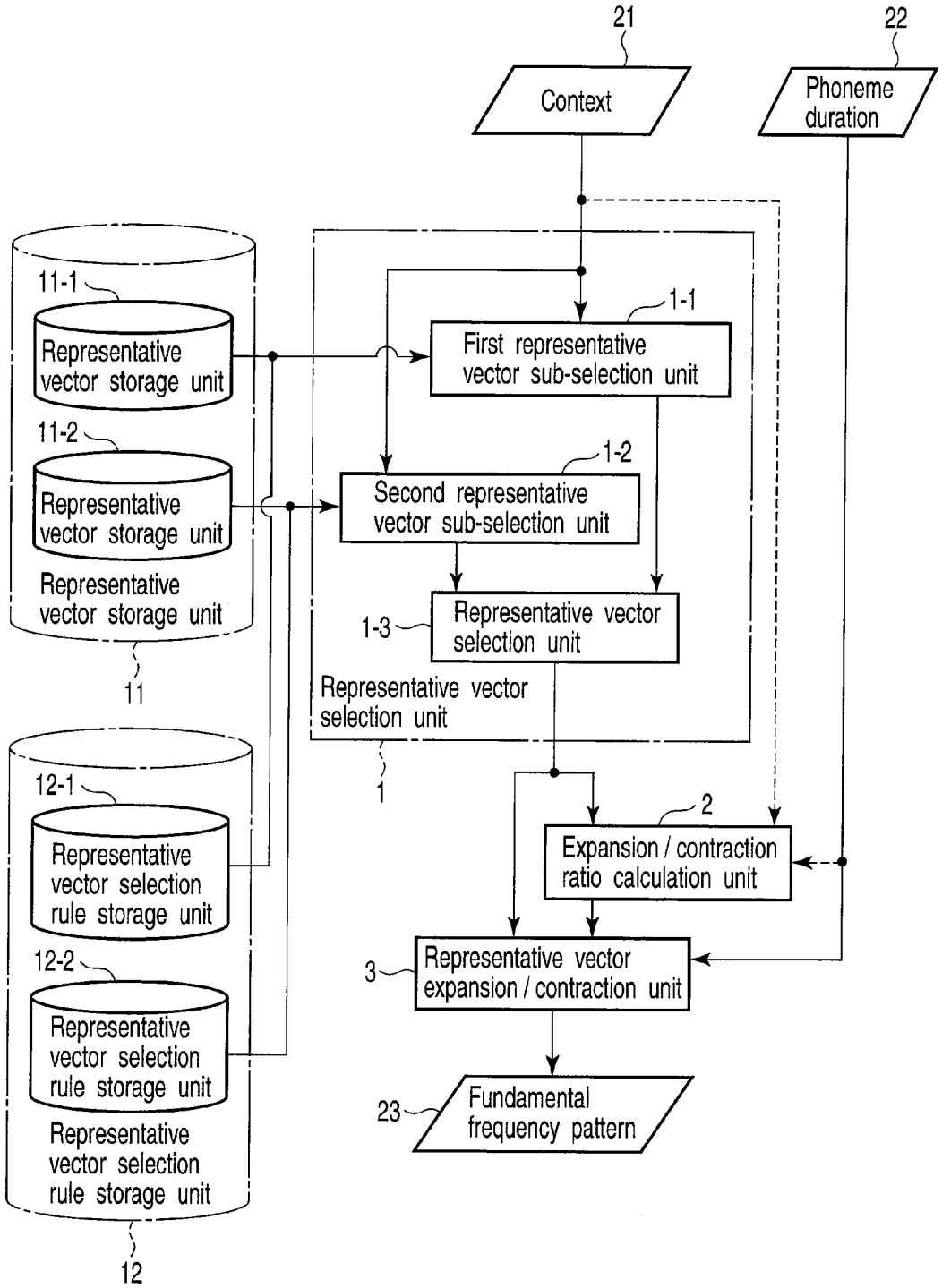
FIG. 19 is a block diagram showing an arrangement example of a fundamental frequency pattern generation apparatus according to the third embodiment.

In FIG. 19, an input phoneme duration 22 is input separately from an input context 21. However, the input context 21 may include, as an item, the input phoneme duration 22 or information capable of specifying the input phoneme duration 22.

The main differences between the fundamental frequency pattern generation apparatus of the third embodiment and that of the first embodiment are that a representative vector selection unit 1 of the first embodiment includes a first representative vector sub-selection unit 1-1, second representative vector sub-selection unit 1-2, and representative vector concatenating unit 1-3, a representative vector storage unit 11 of the first embodiment includes a first representative vector storage unit 11-1 and a second representative vector storage unit 11-2, and a representative vector selection rule storage unit 12 of the first embodiment includes a first representative vector selection rule storage unit 12-1 and a second representative vector selection rule storage unit 12-2 in the third embodiment.

The operation of the fundamental frequency pattern generation apparatus according to this embodiment will be described next.

Figure 20:
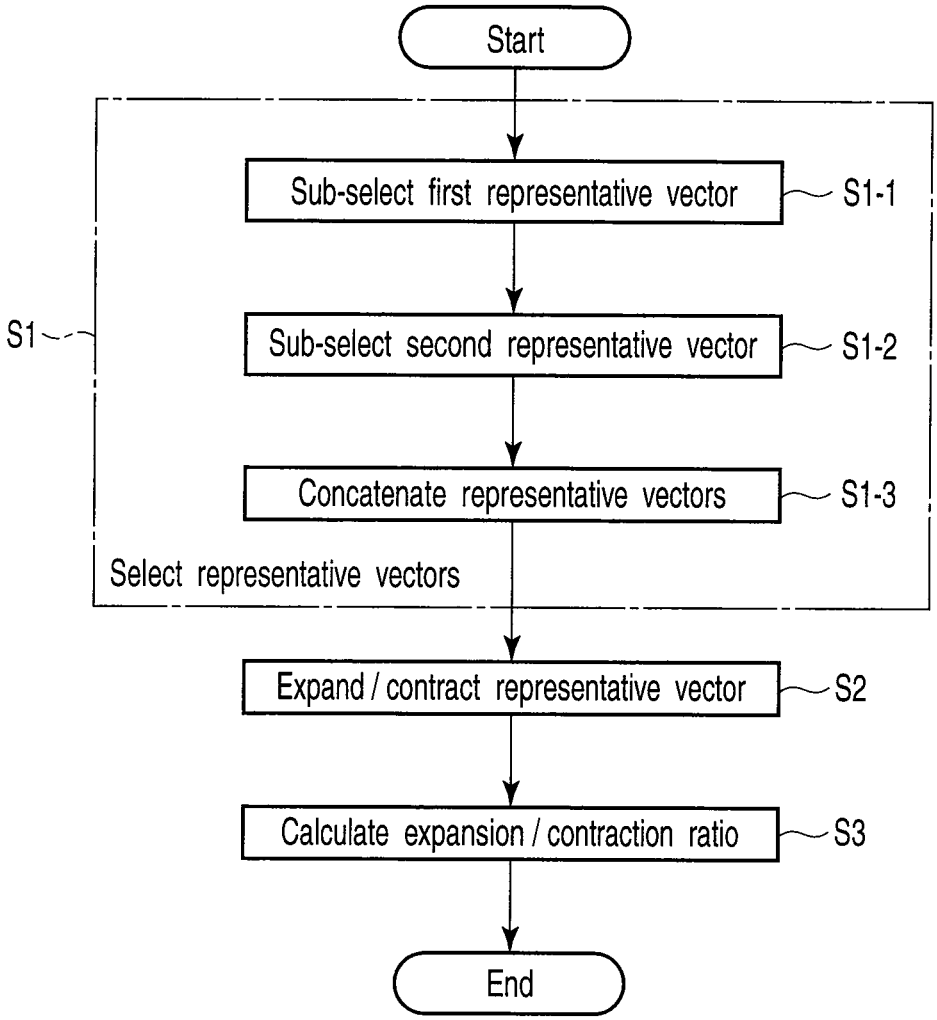
FIG. 20 is a flowchart illustrating an example of the operation of the embodiment.

FIG. 20 illustrates an exemplary process procedure of the fundamental frequency pattern generation apparatus. The same step numbers as in FIG. 4 denote equivalent steps in FIG. 20.

Figure 21:
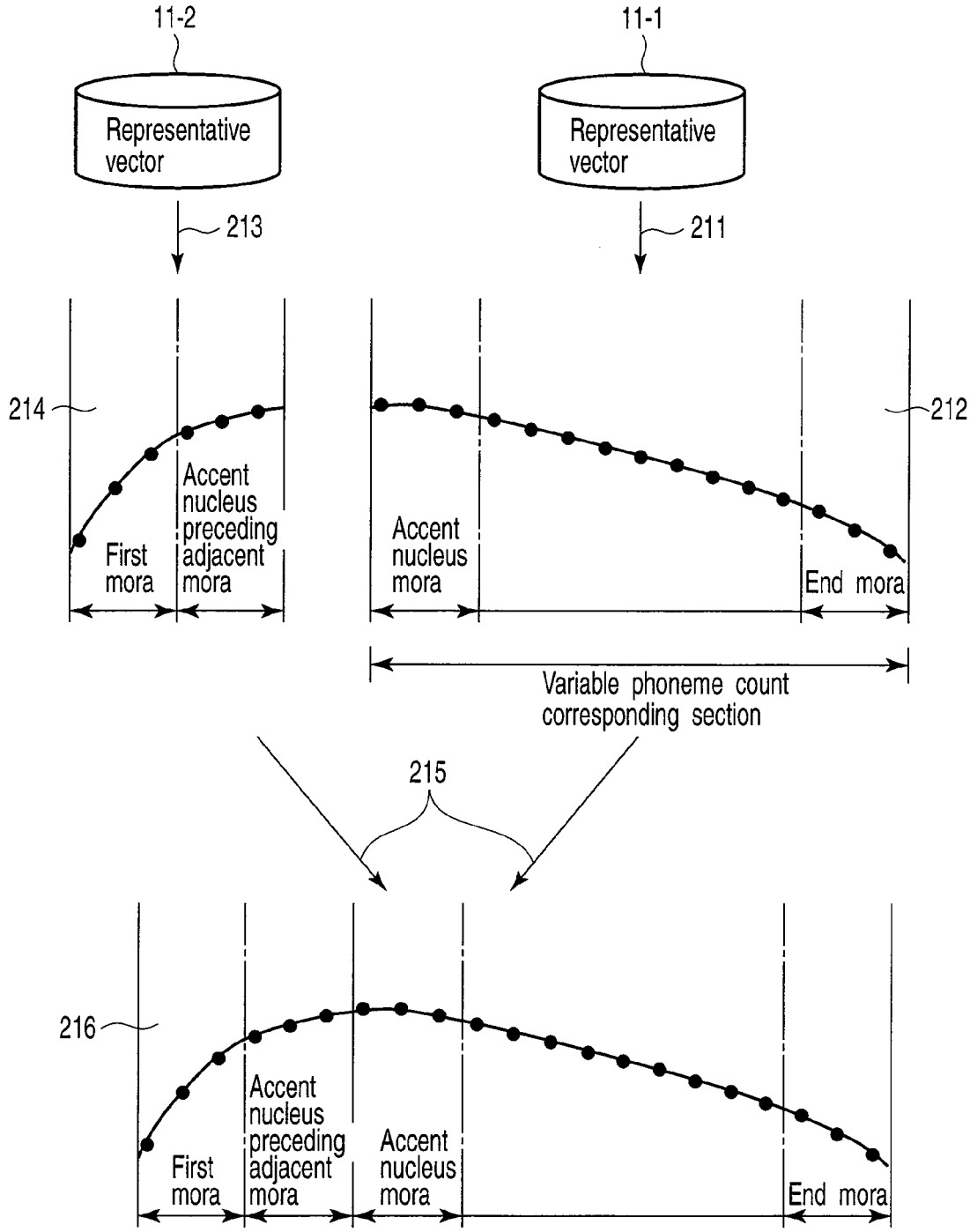
FIG. 21 is a graph for explaining an example of the operation of a representative vector concatenating unit according to the embodiment.

FIG. 21 shows an exemplary representative vector selection.

The third embodiment is different from the first embodiment in two points. The first difference is the representative vector and the representative vector selection rule. In the first embodiment, a representative vector includes a "variable phoneme count corresponding section" and a "first-half phoneme corresponding section" (FIG. 3). In the third embodiment, a representative vector is divided into a first representative vector (212 in FIG. 21) having a "variable phoneme count corresponding section" and a second representative vector (214 in FIG. 21) having a "first-half phoneme corresponding section" so that a plurality of first representative vectors and a plurality of second representative vectors are prepared. Accordingly, in this embodiment, first representative vector selection rules for selecting a first representative vector and second representative vector selection rules for selecting a second representative vector are prepared.

The second difference is the representative vector selection unit 1. In the first embodiment, the representative vector selection unit 1 only outputs a representative vector selected from the representative vector storage unit 11. In the third embodiment, however, the first representative vector sub-selection unit 1-1 selects a first representative vector (211 in FIG. 21), and the second representative vector sub-selection unit 1-2 selects a second representative vector (213 in FIG. 21). The representative vector concatenating unit 1-3 concatenates the selected two representative vectors (i.e., the first and second representative vectors (215 in FIG. 21)). The representative vector selection unit 1 outputs a thus obtained representative vector (216 in FIG. 21) to an expansion/contraction ratio calculation unit 2 and a representative vector expansion/contraction unit 3.

The first difference will be described.

The representative vector storage unit 11 of this embodiment includes the first representative vector storage unit 11-1 which stores a plurality of first representative vectors each having a "variable phoneme count corresponding section" which is the section from an "accent nucleus phoneme" to a "prosodic control unit end phoneme," and the second representative vector storage unit 11-2 which stores a plurality of second representative vectors each having a "first-half phoneme corresponding section" which is the section from a "prosodic control unit start phoneme" to an "accent nucleus preceding adjacent phoneme." The representative vector selection rule storage unit 12 includes the first representative vector selection rule storage unit 12-1 which selects a first representative vector corresponding to the input context 21 from the first representative vector storage unit 11-1, and the second representative vector selection rule storage unit 12-2 which selects a second representative vector corresponding to the input context 21 from the second representative vector storage unit 11-2.

In the above description, the first representative vector storage unit 11-1 and the second representative vector storage unit 11-2 are independently arranged. However, one representative vector storage unit may be formed by integrating the first representative vector storage unit 11-1 and the second representative vector storage unit 11-2. This also applies to the first representative vector selection rule storage unit 12-1 and the second representative vector selection rule storage unit 12-2.

The representative vector selection rule storage unit 12 may include only the first representative vector selection rule storage unit 12-1 so that both the first and second representative vectors are selected using a representative vector selection rule stored in the first representative vector selection rule storage unit 12-1.

The second difference will be described.

A representative vector selection step S1 of this embodiment includes a first representative vector sub-selection step S1-1, second representative vector sub-selection step S1-2, and representative vector concatenating step S1-3.

In the first representative vector sub-selection step S1-1 in FIG. 20, the first representative vector sub-selection unit 1-1 selects the first representative vector 212 (211 in FIG. 21) from the first representative vector storage unit 11-1. In the second representative vector sub-selection step S1-2, the second representative vector sub-selection unit 1-2 selects the second representative vector 214 (213 in FIG. 21) from the second representative vector storage unit 11-2. In the representative vector concatenating step S1-3 (215 in FIG. 21), the first representative vector 212 and the second representative vector 214 selected in the above two steps are concatenated (215 in FIG. 21) to generate the representative vector 216 corresponding to the input context 21.

In this way, short representative vectors are selected and concatenated to output a representative vector corresponding to a control unit or a longer control unit. This increases the types of representative vectors to be output. It is therefore possible to generate a more natural fundamental frequency pattern and also decrease the capacity of the representative vector storage unit.

Either of the first representative vector sub-selection step S1-1 and the second representative vector sub-selection step S1-2 can be executed first. Alternatively, they may be executed in parallel.

In the above description, first representative vector sub-selection unit 1-1 and the second representative vector sub-selection unit 1-2 are independently arranged. However, one representative vector selection unit may be formed by integrating the first representative vector sub-selection unit 1-1 and the second representative vector sub-selection unit 1-2.

In the above description, the representative vector concatenating unit 1-3 is included in the representative vector selection unit. However, the representative vector concatenating unit 1-3 may be separated from the representative vector selection unit.

The representative vector concatenating unit 1-3 may be arranged after the representative vector expansion/contraction unit 3.

The representative vector concatenating unit 1-3 may perform not only the process of concatenating the representative vectors but also a general process such as smoothing or interpolation to smoothen the concatenation boundary.

If a representative vector includes a "first-half phoneme corresponding section," "variable phoneme count corresponding section," and "second-half phoneme corresponding section," a plurality of representative vectors 1 corresponding to the "first-half phoneme corresponding section," a plurality of representative vectors 2 corresponding to the "variable phoneme count corresponding section," and a plurality of representative vectors 3 corresponding to the "second-half phoneme corresponding section" are prepared. A selection rule for the representative vectors 1, a selection rule for the representative vectors 2, and a selection rule for the representative vectors 3 are applied to the input context. A representative vector 1, representative vector 2, and representative vector 3 may be selected in this way and concatenated.

In the above description, a representative vector is divided into a plurality of sections. The arrangement of the expansion/contraction ratio calculation unit 2 and the representative vector expansion/contraction unit 3 in the first embodiment is employed as the arrangement after selection in each section. However, the arrangement of the expansion/contraction ratio calculation unit 2 and the representative vector expansion/contraction unit 3 of the second embodiment may be employed.

As described above, in this embodiment, to generate a fundamental frequency pattern containing various numbers of phonemes, a representative vector serving as a prosodic control unit is divided into a first representative vector corresponding to a variable phoneme count corresponding section and a second representative vector corresponding to a remaining section. The first and second representative vector selection rules are applied to an input context to select the first and second representative vectors corresponding to it, respectively. The two selected representative vectors are concatenated. Then, expansion/contraction ratio calculation and representative vector expansion/contraction are done, as in the first and second embodiments, thereby generating a fundamental frequency pattern. This allows stable generation of natural synthesized speech closer to speech uttered by a human.

This fundamental frequency pattern generation apparatus can also be implemented by using, for example, a general-purpose computer apparatus as basic hardware. More specifically, the representative vectors, representative vector selection rules, representative vector storage units 11-1 and 11-2, representative vector selection rule storage units 12-1 and 12-2, expansion/contraction ratio calculation unit 2, and representative vector expansion/contraction unit 3 can be implemented by causing the processor of the computer apparatus to execute programs. At this time, the fundamental frequency pattern generation apparatus may be implemented by either installing the programs in the computer apparatus in advance or storing the programs in a storage medium such as a CD-ROM or distributing them via a network and appropriately installing them in the computer apparatus. The representative vectors and representative vector selection rules can be implemented by appropriately using an internal or external memory or hard disk of the computer apparatus or a storage medium such as a CD-R, CD-RW, DVD-RAM, or DVD-R.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fundamental frequency pattern generation apparatus comprising:

a computer apparatus comprising a non-transitory computer readable storage medium and a processor;

a first storage unit comprising the non-transitory computer readable storage medium storing a plurality of representative vectors each corresponding to a prosodic control unit and having a first section including a plurality of sample points and a section except for the first section, wherein the first section is a section of the representative vector, which starts with one of an accent nucleus phoneme, an accent nucleus succeeding adjacent phoneme, and an accent nucleus succeeding second phoneme and ends with one of a prosodic control unit end phoneme, a prosodic control unit end preceding adjacent phoneme, and prosodic control unit end preceding second phoneme;

a second storage unit comprising the non-transitory computer readable storage medium storing a rule to select a representative vector corresponding to an input context;

a selection unit configured to select the representative vector corresponding to the input context from the plurality of representative vectors by applying the rule to the input context and output the selected representative vector;

a calculation unit comprising the processor configured to calculate, using a mapping function, an expansion/contraction ratio for a number of phonemes included in the first section of the selected representative vector based on first designated values for a number of phonemes included in a first portion of a fundamental frequency pattern to be generated from the first section of the selected representative vector, the first designated values being required for the fundamental frequency pattern to be generated, such that the number of the phonemes included in the first section of the selected representative vector equals the first designated value, and an expansion/contraction unit comprising the processor configured to expand/contract the number of the phonemes included in the first section of the selected representative vector based on the expansion/contraction ratio, and then to expand/contract each of the phoneme durations of the phonemes included in all sections of the selected representative vector after the number of the phonemes included in the first section are expanded/contracted, based on second designated values corresponding to phoneme durations of all phonemes included in all portions of the fundamental frequency pattern, the second designated values being required for the fundamental frequency pattern to be generated, such that the phoneme durations of the phonemes included in all sections of the selected representative vector after the number of the phonemes included in the first section are expanded/contracted equal the second designated values corresponding to the phoneme durations, to generate the fundamental frequency pattern.

2. The apparatus according to claim 1, wherein the calculation unit calculates one of an expansion/contraction ratio sequence which monotonically increases from a start of the first section and then monotonically decreases to an end of the first section, and an expansion/contraction ratio sequence which monotonically decreases from the start of the first section and then monotonically increases to the end of the first section.

3. The apparatus according to claim 1, wherein the section except the first section of the representative vector is a second section from a prosodic control unit start phoneme to one of an accent nucleus preceding adjacent phoneme, an accent nucleus phoneme, and an accent nucleus succeeding adjacent phoneme, and wherein the representative vector includes the second section and the first section following to the second section.

4. The apparatus according to claim 1, wherein the section except the first section of the representative vector includes a second section from a prosodic control unit start phoneme to one of an accent nucleus preceding adjacent phoneme, an accent nucleus phoneme, and an accent nucleus succeeding adjacent phoneme, and a third section from a succeeding adjacent phoneme to the first section to a prosodic control unit end phoneme, and wherein the representative vector includes the second section, the first section following to the second section, and the third section following to the second section.

5. The apparatus according to claim 1, wherein the prosodic control unit is at least one of a sentence unit, a breath group unit, an accent phrase unit, a morpheme unit, a word unit, a mora unit, a syllable unit, a phoneme unit, a semi-phoneme unit, a unit obtained by dividing one phoneme into a plurality of parts, and a unit formed by combining two or more of them.

6. The apparatus according to claim 1, wherein the context contains language information about the prosodic control unit, which is obtained by analyzing a text.

7. The apparatus according to claim 1, wherein the context contains a value of an arbitrary attribute.

8. The apparatus according to claim 7, wherein the attribute is at least one of information about prominence, information about an utterance style, information representing an intention, and information representing a mental attitude.

9. The apparatus according to claim 1, wherein the phoneme is at least one of a mora, syllable, phoneme, semi-phoneme, and a unit obtained by dividing one phoneme into a plurality of parts.

10. The apparatus according to claim 1, wherein the representative vector is at least one of a fundamental frequency pattern extracted from natural voice, an approximated fundamental frequency pattern obtained by approximating the fundamental frequency pattern, an quantized fundamental frequency pattern obtained by quantizing the fundamental frequency pattern extracted from the natural voice, and an approximated quantized fundamental frequency pattern obtained by approximating the quantized fundamental frequency pattern.

11. The apparatus according to claim 1, wherein the first and second designated values are values obtained from the input context.

12. The apparatus according to claim 1, wherein the first and second designated values are values obtained from input information different from the input context.

13. A fundamental frequency pattern generation apparatus comprising:

a computer apparatus comprising a non-transitory computer readable storage medium and a processor;

a first storage unit comprising the non-transitory computer readable storage medium storing a plurality of representative vectors each corresponding to a prosodic control unit and having a first section and a section except the first section, wherein the first section is a section of the representative vector, which starts with one of an accent nucleus phoneme, an accent nucleus succeeding adjacent phoneme, and an accent nucleus succeeding second phoneme and ends with one of a prosodic control unit end phoneme, a prosodic control unit end preceding adjacent phoneme, and a prosodic control unit end preceding second phoneme;

a second storage unit comprising the non-transitory computer readable storage medium storing a rule to select a representative vector corresponding to an input context;

a selection unit configured to select the representative vector corresponding to the input context from the plurality of representative vectors by applying the rule to the input context and output the selected representative vector;

a calculation unit comprising the processor configured to calculate an expansion/contraction ratio for number of phonemes included in the first section of the selected representative vector, based on a first designated value for a number of phonemes included in a first portion of a fundamental frequency pattern to be generated from the first section of the selected representative vector, the first designated value being required for the fundamental frequency pattern to be generated, such that the number of the phonemes included in the first section of the selected representative vector equals the first designated value; and an expansion/contraction unit comprising the processor configured to expand/contract the number of the phonemes included in the first section of the selected representative vector based on the expansion/contraction ratio and then to expand/contract each of phoneme durations of the phonemes included in all sections of the selected representative vector after the number of the phonemes included in the first section are expanded/contracted, based on second designated values corresponding to phoneme durations of all phonemes included in all portions of the fundamental frequency pattern, the second designated values being required for the fundamental frequency pattern to be generated, such that the phoneme durations of the phonemes included in all sections of the selected representative vector after the number of the phonemes included in the first section are expanded/contracted equal the second designated values corresponding to the phoneme durations, to generate the fundamental frequency pattern.

14. The apparatus according to claim 13, wherein the section except the first section of the representative vector is a second section from a prosodic control unit start phoneme to one of an accent nucleus preceding adjacent phoneme, an accent nucleus phoneme, and an accent nucleus succeeding adjacent phoneme and wherein the representative vector includes the second section and the first section following to the second section.

15. The apparatus according to claim 13, wherein the section except the first section of the representative vector includes a second section from a prosodic control unit start phoneme to one of an accent nucleus preceding adjacent phoneme, an accent nucleus phoneme, and an accent nucleus succeeding adjacent phoneme, and a third section from a succeeding adjacent phoneme to the first section to a prosodic control unit end phoneme, and wherein the representative vector includes the second section, and the first section following to the second section, and the third section following to the first section.

16. The apparatus according to claim 13, wherein the prosodic control unit is at least one of a sentence unit, a breath group unit, an accent phrase unit, a morpheme unit, a word unit, a mora unit, a syllable unit, a phoneme unit, a semi-phoneme unit, a unit obtained by dividing one phoneme into a plurality of parts, and a unit formed by combining two or more of them.

17. The apparatus according to claim 13, wherein the context contains language information about the prosodic control unit, which is obtained by analyzing a text.

18. The apparatus according to claim 13, wherein the context contains a value of an arbitrary attribute.

19. The apparatus according to claim 18, wherein the attribute is at least one of information about prominence, information about an utterance style, information representing an intention, and information representing a mental attitude.

20. The apparatus according to claim 13, wherein the phoneme is at least one of a mora, syllable, phoneme, semi-phoneme, and a unit obtained by dividing one phoneme into a plurality of parts.

21. The apparatus according to claim 13, wherein the representative vector is at least one of a fundamental frequency pattern extracted from natural voice, an approximated fundamental frequency pattern obtained by approximating the fundamental frequency pattern, an quantized fundamental frequency pattern obtained by quantizing the fundamental frequency pattern extracted from the natural voice, and an approximated quantized fundamental frequency pattern obtained by approximating the quantized fundamental frequency pattern.

22. The apparatus according to claim 13, wherein the first and second designated values are values obtained from the input context.

23. The apparatus according to claim 13, wherein the first and second designated values are values obtained from input information different from the input context.

24. The apparatus according to claim 13, wherein the non-transitory computer readable storage medium comprises a device selected from the group consisting of an internal memory of the computer apparatus, an external memory of the computer apparatus, a hard disk of the computer apparatus and a storage medium readable by the computer apparatus.

25. The apparatus according to claim 24, wherein the storage medium is selected from the group consisting of a CD-R, CD-RW, DVD-RAM, and DVD-R.

26. A fundamental frequency pattern generation method comprising:

storing in advance a plurality of representative vectors each corresponding to a prosodic control unit and having a first section and a section except the first section, wherein the first section is a section of the representative vector, which starts with one of an accent nucleus phoneme, an accent nucleus succeeding adjacent phoneme, and an accent nucleus succeeding second phoneme and ends with one of a prosodic control unit end phoneme, a prosodic control unit end preceding adjacent phoneme, and a prosodic control unit end preceding second phoneme;

storing in advance a rule to select a representative vector corresponding to an input context;

selecting, via a computer processor, the representative vector corresponding to the input context from the plurality of representative vectors by applying the rule to the input context and output the selected representative vector;

calculating, via the computer processor, an expansion/contraction ratio for number of phonemes included in the first section of the selected representative vector, based on a designated value for number of phonemes included in a first portion of a fundamental frequency pattern to be generated from the first section of the selected representative vector, the designated value being required for the fundamental frequency pattern to be generated, such that the number of the phonemes included in the first section of the selected representative vector equals the designated value; and expanding/contracting, via the computer processor, the number of the phonemes included in the first section of the selected representative vector based on the expansion/contraction ratio, and then expanding/contracting each of phoneme durations of the phonemes included in all sections of the selected representative vector after the number of the phonemes included in the first section are expanded/contracted, based on designated values corresponding to phoneme durations of all phonemes included in all portions of the fundamental frequency pattern, the designated values being required for the fundamental frequency pattern to be generated, such that the phoneme durations of the phonemes included in all sections of the selected representative vector after the number of the phonemes included in the first section are expanded/contracted equal the designated values corresponding to the phoneme durations, to generate the fundamental frequency pattern.

27. A non-transitory computer readable storage medium storing instructions of a computer program which when executed by a computer results in performance of steps comprising:

storing in advance a plurality of representative vectors each corresponding to a prosodic control unit and having a first section and a section except the first section, wherein the first section is a section of the representative vector, which starts with one of an accent nucleus phoneme, an accent nucleus succeeding adjacent phoneme, and an accent nucleus succeeding second phoneme and ends with one of a prosodic control unit end phoneme, a prosodic control unit end preceding adjacent phoneme, and a prosodic control unit end preceding second phoneme;

storing in advance a rule to select a representative vector corresponding to an input context;

selecting the representative vector corresponding to the input context from the plurality of representative vectors by applying the rule to the input context and output the selected representative vector;

calculating an expansion/contraction ratio for number of phonemes included in the first section of the selected representative vector, based on a designated value for number of phonemes included in a first portion of a fundamental frequency pattern to be generated from the first section of the selected representative vector, the designated value being required for the fundamental frequency pattern to be generated, such that the number of the phonemes included in the first section of the selected representative vector equals the designated value; and expanding/contracting the number of the phonemes included in the first section of the selected representative vector based on the expansion/contraction ratio, and then expanding/contracting each of phoneme durations of the phonemes included in all sections of the selected representative vector after the number of the phonemes included in the first section are expanded/contracted, based on designated values corresponding to phoneme durations of all phonemes included in all portions of the fundamental frequency pattern, the designated values being required for the fundamental frequency pattern to be generated, such that the phoneme durations of the phonemes included in all sections of the selected representative vector after the number of the phonemes included in the first section are expanded/contracted equal the designated values corresponding to the phoneme durations, to generate the fundamental frequency pattern.

28. A fundamental frequency pattern generation method comprising:

storing, in non-transitory storage medium, a plurality of representative vectors each corresponding to a prosodic control unit and having a first section and a section except the first section, wherein the first section is a section of a representative vector;

storing, in non-transitory storage medium, a rule to select a representative vector corresponding to an input context;

selecting, via a computer processor, the representative vector corresponding to the input context from the plurality of representative vectors by applying the rule to the input context and output the selected representative vector;

calculating, via the computer processor, an expansion/contraction ratio for a number of phonemes included in the first section of the selected representative vector based on the selected representative vector such that the number of the phonemes included in the first section of the selected representative vector equals the designated value; and expanding/contracting, via the computer processor, first the number of the phonemes included in the first section of the selected representative vector based on the expansion/contraction ratio and then each of phoneme durations of the phonemes.

29. A fundamental frequency pattern generation method comprising:

preparing in advance a first storage unit to store a plurality of representative vectors each corresponding to a prosodic control unit and having a first section including a plurality of sample points and a section except for the first section, wherein the first section is a section of the representative vector, which starts with one of an accent nucleus phoneme, an accent nucleus succeeding adjacent phoneme, and an accent nucleus succeeding second phoneme and ends with one of a prosodic control unit end phoneme, a prosodic control unit end preceding adjacent phoneme, and prosodic control unit end preceding second phoneme, preparing in advance a second storage unit to store a rule to select a representative vector corresponding to an input context, selecting, via a computer processor, the representative vector corresponding to the input context from the plurality of representative vectors by applying the rule to the input context and outputting the selected representative vector;

calculating, using a mapping function on the computer processor, an expansion/contraction ratio for a number of phonemes included in the first section of the selected representative vector, based on a designated value for a number of phonemes included in a first portion of a fundamental frequency pattern to be generated from the first section of the selected representative vector, the designated value being required for the fundamental frequency pattern to be generated, such that the number of the phonemes included in the first section of the selected representative vector equals the designated value; and expanding/contracting, via the computer processor, the number of the phonemes included in the first section of the selected representative vector based on the expansion/contraction ratio, and then expanding/contracting each of the phoneme durations of the phonemes included in all sections of the selected representative vector after the number of the phonemes included in the first section are expanded/contracted, based on designated values corresponding to phoneme durations of all phonemes included in all portions of the fundamental frequency pattern, the designated values being required for the fundamental frequency pattern to be generated, such that the phoneme durations of the phonemes included in all sections of the selected representative vector after the number of the phonemes included in the first section are expanded/contracted equal the designated values corresponding to the phoneme durations, to generate the fundamental frequency pattern.

30. A non-transitory computer readable storage medium storing instructions of a computer program which when executed by a computer results in performance of steps comprising:

preparing in advance a first storage unit to store a plurality of representative vectors each corresponding to a prosodic control unit and having a first section including a plurality of sample points and a section except for the first section, wherein the first section is a section of the representative vector, which starts with one of an accent nucleus phoneme, an accent nucleus succeeding adjacent phoneme, and an accent nucleus succeeding second phoneme and ends with one of a prosodic control unit end phoneme, a prosodic control unit end preceding adjacent phoneme, and prosodic control unit end preceding second phoneme, preparing in advance a second storage unit to store a rule to select a representative vector corresponding to an input context, selecting the representative vector corresponding to the input context from the plurality of representative vectors by applying the rule to the input context and outputting the selected representative vector;

calculating, using a mapping function on the computer processor, an expansion/contraction ratio for a number of phonemes included in the first section of the selected representative vector, a designated value for a number of phonemes included in a first portion of a fundamental frequency pattern to be generated from the first section of the selected representative vector, the designated value being required for the fundamental frequency pattern to be generated, such that the number of the phonemes included in the first section of the selected representative vector equals the designated value; and expanding/contracting, via the computer processor, the number of the phonemes included in the first section of the selected representative vector based on the expansion/contraction ratio, and then expanding/contracting each of the phoneme durations of the phonemes included in all sections of the selected representative vector after the number of the phonemes included in the first section are expanded/contracted, based on designated values corresponding to phoneme durations of all phonemes included in all portions of the fundamental frequency pattern, the designated values being required for the fundamental frequency pattern to be generated, such that the phoneme durations of the phonemes included in all sections of the selected representative vector after the number of the phonemes included in the first section are expanded/contracted equal the designated values corresponding to the phoneme durations, to generate the fundamental frequency pattern.

* * * * *